US007282659B1

(12) United States Patent
Gibbs et al.

(10) Patent No.: US 7,282,659 B1
(45) Date of Patent: Oct. 16, 2007

(54) PANEL ASSEMBLY APPARATUS

(75) Inventors: Edward L. Gibbs, 1555 N. Mingo Rd., Tulsa, OK (US) 74116; Fred L. Givens, Tulsa, OK (US); Gary W. Vonnahme, Tulsa, OK (US)

(73) Assignee: Edward L. Gibbs, Tulsa, OK (US)

( * ) Notice: Subject to any disclaimer, the term of this patent is extended or adjusted under 35 U.S.C. 154(b) by 212 days.

(21) Appl. No.: 10/666,105

(22) Filed: Sep. 18, 2003

Related U.S. Application Data

(63) Continuation-in-part of application No. 10/140,915, filed on May 7, 2002, now Pat. No. 6,811,145.

(51) Int. Cl.
*B23K 11/10* (2006.01)

(52) U.S. Cl. ..... 219/56; 219/86.24; 219/87

(58) Field of Classification Search ..... 219/56, 219/58, 86.24, 87, 117.1
See application file for complete search history.

(56) References Cited

U.S. PATENT DOCUMENTS

| | | | | |
|---|---|---|---|---|
| 1,630,492 A | | 5/1927 | Kusterle | 403/270 |
| 1,782,234 A | | 11/1930 | Hofmann | 29/DIG. 48 |
| 1,906,296 A | | 5/1933 | Williams | 62/519 |
| 2,218,954 A | | 10/1940 | Gustafson | 256/22 |
| 2,590,929 A | | 4/1952 | Bush | 256/22 |
| 2,909,361 A | | 10/1959 | Dotson | 256/21 |
| 3,033,532 A | | 5/1962 | McFall | 256/21 |
| 3,083,951 A | | 4/1963 | Huret | 256/65.08 |
| 3,139,504 A | * | 6/1964 | Ramstein et al. | 219/56 |
| 3,343,811 A | | 9/1967 | Kusel et al. | |
| D210,519 S | | 3/1968 | Kusel | |
| 3,385,567 A | | 5/1968 | Case et al. | |
| 3,410,544 A | | 11/1968 | Beck | 165/169 |

(Continued)

FOREIGN PATENT DOCUMENTS

GB 2249327 A 5/1992

(Continued)

OTHER PUBLICATIONS

Catalog, Ameristar Fence Products, Inc., "Aegis Ornamental Steel Residential Fencing," all pages, published in the United States no later than Apr. 2001.

(Continued)

*Primary Examiner*—Kevin P. Kerns
(74) *Attorney, Agent, or Firm*—Gary Peterson

(57) ABSTRACT

A panel, such as a fence panel, is assembled by a projection welding process from a plurality of upright members and a plurality of rails. The rails and upright members are first assembled into a flat panel framework, which is introduced into a welding area having multiple welding stations arrayed in a series of rows. Paired welding stations in adjacent odd- and even-numbered rows are positioned on opposite sides of the panel framework. Each welding station is characterized by at least two laterally spaced electrodes of opposite polarity, both situated on the same side of the panel framework. One electrode contacts an underlying rail, while the other electrode contacts an underlying upright member. A welding current transmitted between the electrodes causes an internal weld to form between the upright member and the rail at a projection within the rail channel.

20 Claims, 17 Drawing Sheets

U.S. PATENT DOCUMENTS

| | | | | | |
|---|---|---|---|---|---|
| 3,517,474 | A | | 6/1970 | Lanternier | 52/729.5 |
| 3,596,880 | A | | 8/1971 | Greenberg | |
| 3,597,568 | A | * | 8/1971 | Rach | 219/56 |
| 3,612,291 | A | | 10/1971 | Skubic | 211/208 |
| 3,799,506 | A | | 3/1974 | Schwartz | 256/24 |
| 4,023,683 | A | | 5/1977 | Vargo | 211/192 |
| 4,174,475 | A | * | 11/1979 | Senn | 219/56 |
| 4,188,019 | A | | 2/1980 | Meredith | |
| 4,204,375 | A | | 5/1980 | Good | 403/262 |
| 4,238,117 | A | | 12/1980 | Newman | |
| D293,718 | S | | 1/1988 | Poma | |
| 4,883,256 | A | | 11/1989 | Hebda | |
| 4,917,284 | A | * | 4/1990 | Candiracci | 228/5.1 |
| 4,995,591 | A | | 2/1991 | Humphrey et al. | |
| D324,506 | S | | 3/1992 | Phillips | |
| 5,136,813 | A | | 8/1992 | Gibbs et al. | |
| 5,272,838 | A | | 12/1993 | Gibbs | |
| 5,345,723 | A | | 9/1994 | Gibbs | |
| 5,403,985 | A | * | 4/1995 | Ahn | 219/56 |
| 5,443,244 | A | | 8/1995 | Gibbs | |
| 5,927,041 | A | | 7/1999 | Sedlmeier et al. | 52/730.1 |
| 5,971,365 | A | | 10/1999 | Pigott et al. | |
| 6,029,954 | A | | 2/2000 | Murdaca | |
| D424,213 | S | | 5/2000 | Chaney et al. | |
| 6,151,772 | A | | 11/2000 | Pigott et al. | |
| 6,176,043 | B1 | | 1/2001 | Gibbs | |
| 6,254,064 | B1 | | 7/2001 | Gibbs | |
| D465,856 | S | | 11/2002 | Givens et al. | |
| D466,620 | S | | 12/2002 | Givens et al. | |
| D467,669 | S | | 12/2002 | Givens et al. | |
| D468,028 | S | | 12/2002 | Givens et al. | |
| 6,519,908 | B1 | | 2/2003 | Masterson et al. | 52/696 |
| 6,627,832 | B2 | * | 9/2003 | Vittone | 219/58 |
| 6,739,583 | B2 | | 5/2004 | Ryon | 256/65.02 |
| 6,811,145 | B2 | * | 11/2004 | Gibbs et al. | 256/22 |
| 6,817,155 | B2 | | 11/2004 | Larson | 52/690 |
| 6,912,787 | B1 | | 7/2005 | Ruble et al. | 29/897.31 |
| 7,071,439 | B2 | * | 7/2006 | Gibbs et al. | 219/93 |

FOREIGN PATENT DOCUMENTS

| | | | |
|---|---|---|---|
| GB | 2350846 | A | 12/2000 |
| GB | 2363400 | A | 12/2001 |
| GB | 2372758 | A | 9/2002 |
| GB | 2372759 | A | 9/2002 |
| WO | WO-95/33113 | | 12/1995 |
| WO | WO-02/070838 | A1 | 9/2002 |

OTHER PUBLICATIONS

Catalog, Ameristar Fence Products, Inc., "Aegis II Industrial Aegis Plus Commercial Ornamental Steel Fence and TransPort namental Gates," all pages, published in the United States in Aug. 2000.

* cited by examiner

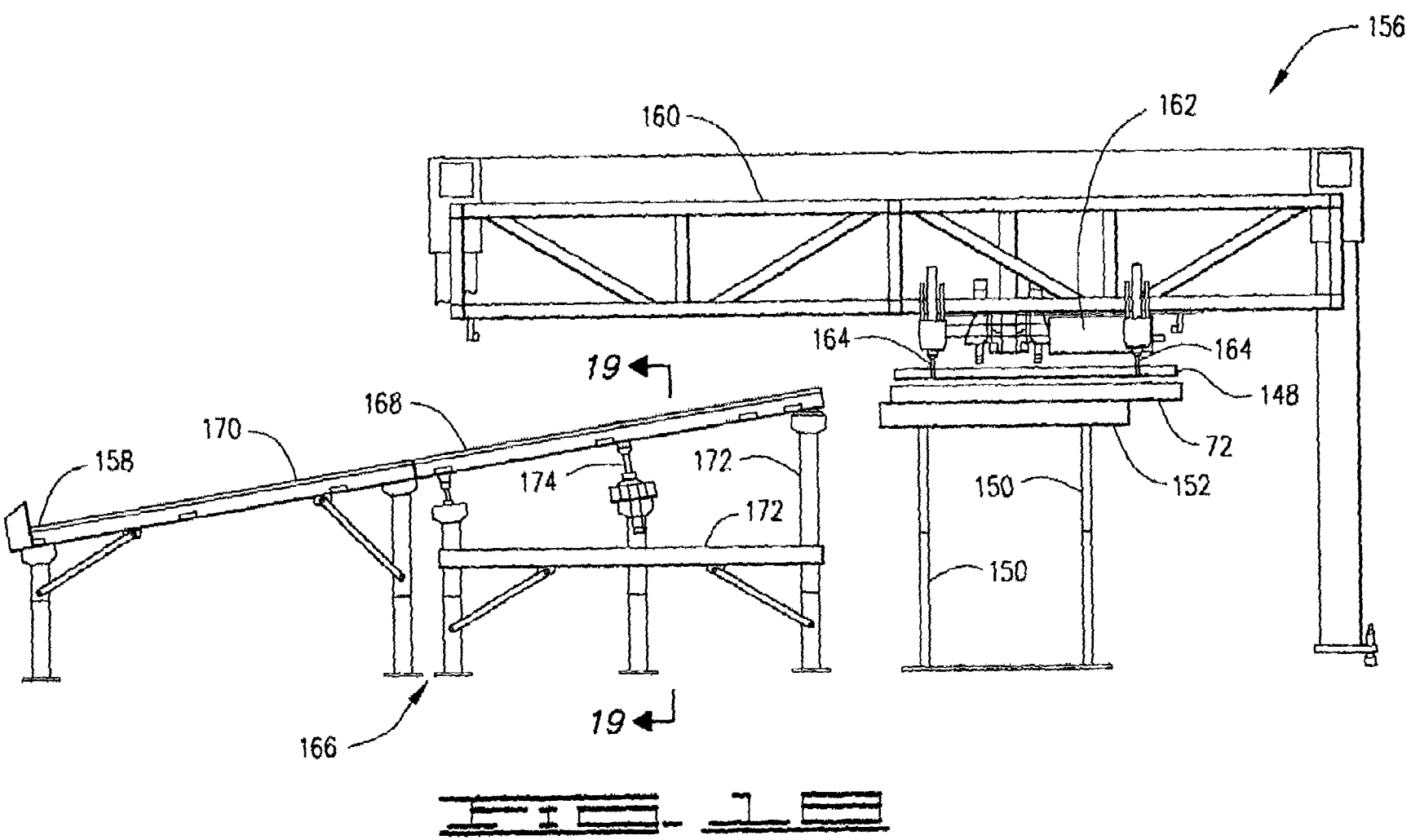
156
162
164
148
72
152
150
150
164
160
172
172
19
19
174
168
166
170
158

PANEL ASSEMBLY APPARATUS

CROSS-REFERENCE TO RELATED APPLICATION

This application is a continuation-in-part of U.S. patent application Ser. No. 10/140,915, filed May 7, 2002, now U.S. Pat. No. 6,811,145, which is incorporated by reference in its entirety.

FIELD OF THE INVENTION

The present invention relates generally to panels, such as those used to form a fence or handrail, assembly methods for such panels, and more particularly to methods and apparatus for panel assembly using a projection welding process.

SUMMARY OF THE INVENTION

The present invention comprises a method of assembling a panel from at least one conductive upright member and at least one elongate conductive rail having a rail channel. A first upright member is transversely positioned within the rail channel of a first rail to form a substantially flat panel framework having a first side and an opposed second side. A first electrode contacts the first rail at a first contact position on the first side of the panel framework. A second electrode, having a polarity opposed to the first electrode, contacts the first upright member at a second contact position on the first side of the panel framework. A welding current is then transmitted between the first and second electrodes to produce a weld within the rail channel which joins the first upright member to the first rail.

The invention further comprises an apparatus for welding a panel. The apparatus comprises a welding area in which a flat panel framework having opposed first and second sides may be horizontally positioned in a first welding position. A first welding station, comprising adjacent electrodes of opposed polarity, is situated in a first row within the welding area and is positionable adjacent the first side of a panel framework in the first welding position. A second welding station, comprising adjacent electrodes of opposed polarity, is situated in a second row within the welding area, spaced from the first row, and is positionable adjacent the second side of a panel framework in the first welding position.

BRIEF DESCRIPTION OF THE DRAWINGS

FIG. 2 is a cross-sectional view of the rail shown in FIG. 1, taken along line 2-2.

FIG. 6 is cross-sectional view of the rail and upright member shown in FIG. 5, in assembled form after welding has taken place.

FIGS. 8A and 8B are front elevational views of the apparatus shown in FIGS. 7A and 7B, with FIG. 8A showing the upstream section and FIG. 8B showing the downstream section of the apparatus. The output ramp system has been omitted from FIG. 8B, in order to permit better display of other components.

FIG. 9 is an enlarged front elevational view of the welding zone of the assembly apparatus shown in FIG. 8B, with a partially assembled panel framework in the first welding position. The pallet which supports the panel framework and the conveyor systems and rollers which move and support the pallet have been omitted, in order to better display other components.

FIG. 11 is a side cross-sectional view of the welding zone in FIG. 9, taken along line 11-11, showing a portion of the first row of welding stations and a partially assembled panel framework in the first welding position.

FIG. 18 is a side view showing the output conveyor system, output ramp system and downstream lift of the apparatus of the present invention, with the output conveyor system in its loading position, the output ramp system in its lowered position, and the downstream lift in its upper position. Structural components have been omitted to permit better display of other components.

DETAILED DESCRIPTION

The present invention comprises an assembly method and apparatus for manufacturing panels, or sections, of a barrier such as a fence or hand rail. Such a barrier may be formed by supporting a plurality of panels on a network of adjacent posts (not shown), with each panel supported by, and extending between, an adjacent pair of posts.

Figure 4:
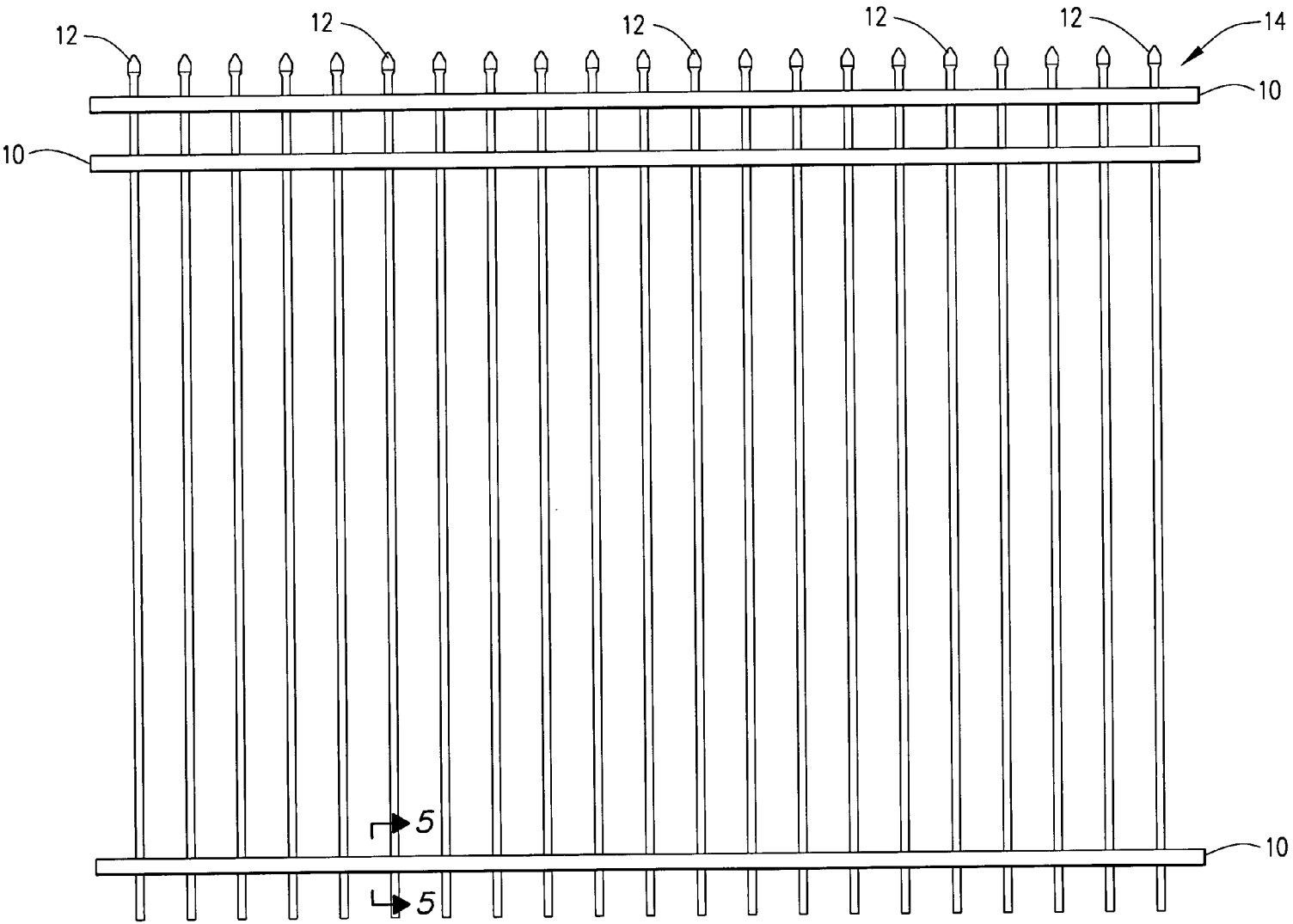
FIG. 4 is a top plan view of a panel framework formed partial assembly of two parallel rails, of the type shown in FIG. 1, with a plurality of transversely positioned upright members, shown prior to welding.

As best shown in FIG. 4, the panel of the present invention is formed by assembling one or more elongate conductive rails 10, and one or more conductive upright members 12, to form a substantially flat panel framework 14. The panel framework 14 is characterized by a first side 16, and an opposed second side 18, shown in FIG. 9. The components comprising the panel framework 14 are welded together at their points of contact to form a finished, integral panel.

With continued reference to FIG. 4, the panel framework 14 is preferably formed from a plurality of spaced and parallel rigid rails 10, and a plurality of spaced and parallel rigid upright members 12, such as the pickets shown in the Figures. The upright members 12 forming the panel framework 14 preferably extend in transverse, substantially perpendicular, relationship to the rails 10 forming the panel framework 14. When a plurality of rails 10 are provided, these rails 10 preferably are disposed in parallel relationship.

While any number of rails 10 may be provided for the panel framework 14, either three rails, as shown in FIG. 4, or two rails, are preferred. The number of upright members 12 provided for the panel framework 14 should be sufficiently great to assure that the separation distance between adjacent upright members 12, or between a post and an adjacent upright member 12, will not permit an intruder to travel between them. For example, in a panel to be installed between posts which are separated by an 8-foot distance, twenty-one upright members may be provided, with a uniform separation distance of between about 4 and about 5 inches, and more preferably about 4.334 inches.

Figure 1:
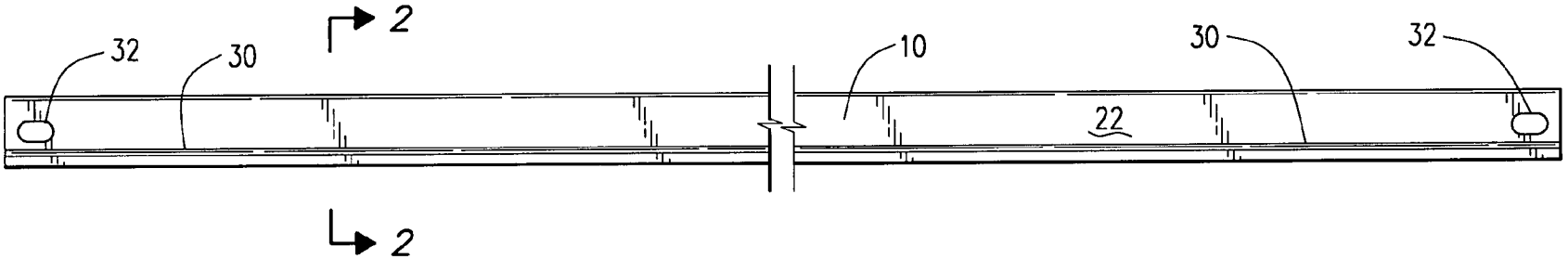
FIG. 1 is an enlarged and detailed front elevational view of one of the rails used in the panel of the present invention, prior to its assembly.
Figure 3:
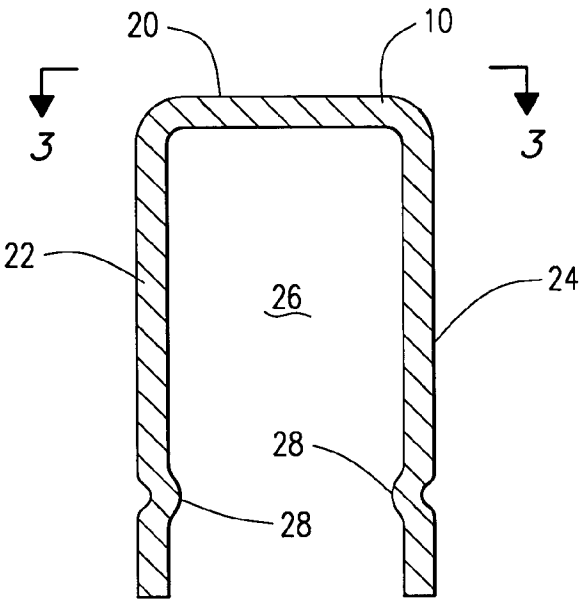
FIG. 3 is a top plan view of the rail shown in FIGS. 1 and 2, taken along line 3-3.
Figure 1:
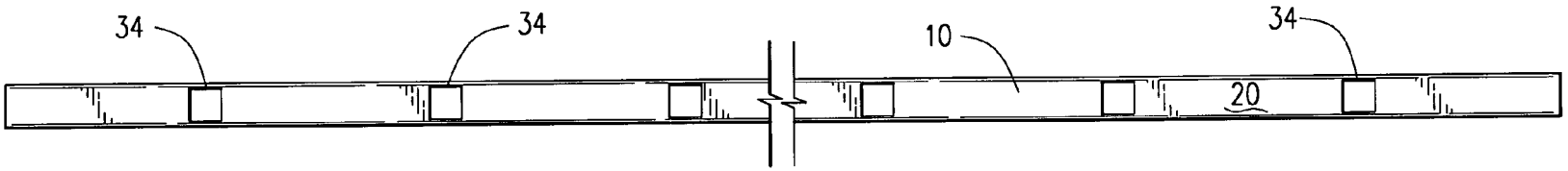
Figure 3:
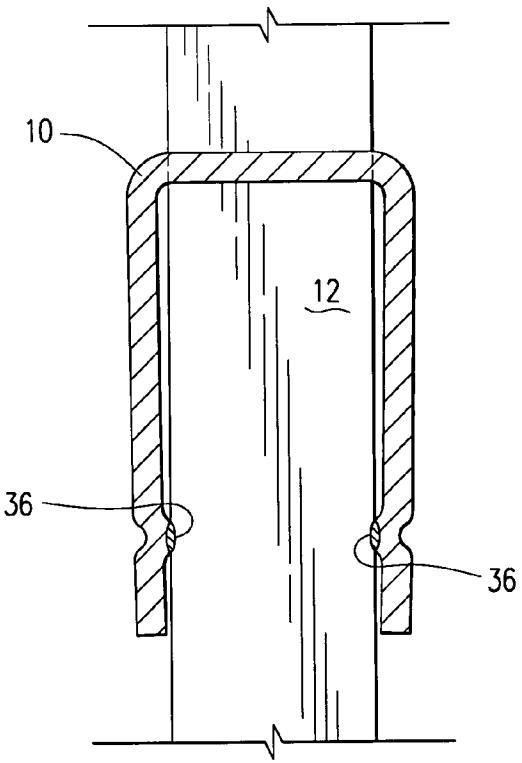

As best shown in FIGS. 1, 2 and 3, each rail 10 is preferably characterized by an elongate flat web 20 and a pair of opposed side walls 22 and 24 which extend from the web 20, and a straight-line longitudinal axis. The web 20 and side walls 22 and 24 collectively define a U-shaped rail channel 26. The length of each rail 10 should be sufficient to fully span the distance between the adjacent of pair of posts which will support the panel into which the rail 10 will be incorporated.

Each rail 10 is preferably formed from a strong, durable and conductive material, such as a sheet steel or aluminum. In a preferred embodiment of the present invention, the sheet is characterized by a thickness of 0.075 inches. In order to enhance its resistance to corrosion, the sheet is preferably subjected to a pre-galvanizing treatment. The pre-galvanized sheet is then subjected to a cold rolling process to produce the cross-sectional shape shown in FIG. 2.

At least one, and preferably both, of the side walls 22 and 24 include a weld-forming region 28 which projects within the rail channel 26. In the embodiment of the rail 10 shown in FIGS. 1, 2 and 3, a weld-forming region has been formed in each side wall. Each weld-forming region 28 comprises a longitudinal ridge which extends along at least a portion of the length of its respective side wall, preferably in substantially parallel relationship to the longitudinal axis of the rail 10. More preferably, each ridge extends continuously along substantially the entire length of its associated side wall.

When the weld-forming regions comprise ridges, they are preferably formed during the cold rolling process. One or more continuous longitudinal scores 30 are preferably formed in the surface of the sheet which will not define the rail channel 26. These scores 30 cause ridges to protrude from the opposite surface of the sheet. When that surface is formed into the rail channel 26 by the cold rolling process, each of the protrusions will define an elongate ridge which projects within the rail channel 26 and comprises a weld-forming region 28, as shown in FIG. 2.

The dimensions of each weld-forming region 28 should be selected so that the region can effectively concentrate a welding current flow. When the rail 10 is formed from a sheet having a thickness of 0.075 inches, a preferred height for the weld-forming region 28, with respect to its associated side wall, is 0.035 inches. A preferred width for the weld-forming region 28 is 0.143 inches. A pointed and or angular profile for the weld-forming region 28 is preferred.

Opposed and aligned fastener openings 32 are preferably formed at each of the side walls 22 and 24, preferably at each of the opposite ends of the rail 10. A plurality of longitudinally spaced top openings 34 are preferably also formed in the web 20 of at least one of the rails 10, more preferably in all of the rails 10, with the possible exception of the uppermost rail 10. In the embodiment shown in FIGS. 1-4, top openings 34 are formed in all of the rails 10. Preferably, the fastener openings 32 and top openings 34 are formed by punching from the sheet used to form the rail 10, before that sheet undergoes the cold rolling process used to form the rail 10.

The top openings should be characterized by a uniform size and shape, which preferably is rectangular, and preferably are provided in a number equal to the number of upright members 12 forming the panel framework 14. The top openings 34 should be situated at those sites on the rail 10 at which upright members 12 are to be attached, as will be described in greater detail hereafter.

Each upright member 12 is preferably formed from a strong, durable and conductive material, such as sheet steel or aluminum. In a preferred embodiment of the present invention, the sheet used to form the upright member 12 is characterized by a thickness of 0.040 inches. In order to enhance its resistance to corrosion, this sheet is preferably subjected to a pre-galvanizing treatment. The pre-galvanized sheet is then subjected to a cold rolling process to form the upright member into a tubular configuration, preferably having a rectangular cross-section.

Each of the upright members 12 is preferably sized to be closely but clearingly received within the rail channel 26 of each rail 10, and to be closely but clearingly received through any top openings 34 formed in any of the rails 10 to which it will be attached. The vertical height of each upright member 12 is preferably approximately equal to the above-ground vertical height of the posts used to support the barrier. In the embodiment shown in FIG. 1, each upright member 12 is characterized by a substantially straight-line longitudinal axis. Alternately, each upright member may be characterized by a longitudinal axis having a lower portion which is straight, in the area of the point or points of attachment to the rail 10, and an upper portion which bends or curves away from the straight lower portion. When a plurality of upright members 12 are provided, they are preferably identical.

Figure 5:
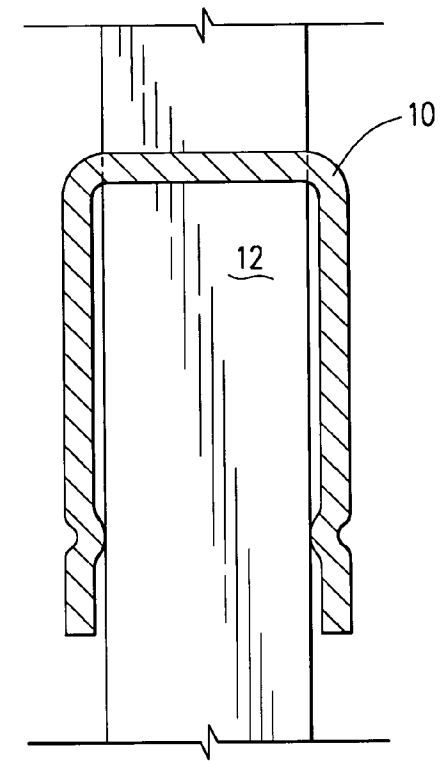
FIG. 5 is cross-sectional view of a rail and upright member of the panel framework of FIG. 4 taken along line 5-5, shown prior to welding.

As shown in FIGS. 4 and 5, the panel framework 14 is assembled by transversely positioning a first upright member 46 within the rail channel 26 of a first rail 10, preferably such that it fully traverses the rail channel 26 and extends through the top opening 34, if any. If the panel framework 14 comprises a plurality of rails 10, such as the second and third rails 10 shown in FIG. 4, the first upright member 46 should also be transversely positioned within the rail channel of each additional rail 10 comprising the panel framework 14, preferably such that it fully traverses the rail channel of each additional rail 10, and extends through the top opening 34, if any, of each such rail. While positioned within a rail channel 26 as described above, each upright member 12 should contact at least one, and preferably an opposed pair, of the projecting weld-forming regions 28 formed in the rail 10.

A second upright member 48 is preferably positioned within the rail channel 26 of the same first rail 10, such that it contacts the projecting region 28, fully traverses the rail channel 26, and passes through its associated top opening 34, if any. This second upright member 48 is disposed in parallel relationship to the first upright member 46, and preferably in side-to-side, immediately adjacent relationship to the first upright member 46. If the panel framework 14 comprises a plurality of rails 10, such as the second and third rails 10 shown in FIG. 4, the second upright member 48 should also be transversely positioned within the rail channel of each additional rail 10 comprising the panel framework 14, preferably such that it fully traverses the rail channel of each additional rail 10, and extends through the top opening 34, if any, of each such rail.

The foregoing steps are repeated with additional upright members 12 until each upright members 12 comprising the panel framework 14 have been installed in the rail channel of each of the rails 10 comprising the panel framework 14, as shown in FIG. 4. The order in which rails 10 and upright members 12 are assembled is not critical, and any convenient sequence of steps may be used. In one preferred assembly sequence, the rails 10 comprising the panel framework are first aligned in parallel and side-to-side relationship with a jig (not shown), and upright members 12 are then installed into the rails 10 by extension through the aligned top openings 34.

In the next stage of assembly, a first electrode having a first polarity contacts the rail 10 at a first contact position, and a second electrode, having a second polarity opposed to the first polarity, contacts the upright member 12 at a second contact position. Preferably, the contact position of each electrode is near the weld-forming region 28 of the rail 10. A welding current is then transmitted between the rail-contacting electrode and the upright member-contacting electrode.

The welding current is of sufficient of magnitude, and applied for sufficient time, so that the electrical resistance of the rail 10 causes each of the weld-forming regions 28 contacting the upright member 12 to heat up and at least partially melt. Current flow is then terminated, and the melted portions of the weld-forming regions cool to form welds 36, as shown in FIG. 6. In order to enhance the strength of the welds, the rail 10 is preferably compressed during the periods of current flow and cooling, such that each of the weld-forming regions 28 is pressed against upright member 12. The compressive force is preferably applied, at least in part, by the electrodes.

Each of the resulting welds 36 is situated within the rail channel 26 and joins the upright member 12 to the rail 10, resulting in a upright member-rail assembly. When the upright member 12 contacts an opposed pair of weld-forming regions 28, as shown in FIG. 6 an opposed pair of welds 36 is formed within the rail channel 26.

The source of the welding current is preferably a direct current inverter power supply, such as the model IS-471B, manufactured by Unitek Myachi Corporation of Monrovia, Calif. Such a power supply converts commercial alternating current into a high frequency direct current which is fed via a transformer to electrodes in a welding head. In one preferred embodiment, a weld current of 22,000 amperes and a frequency of 1000 Hertz is used to form the welds. Preferably 2 cycles of such a current is used to form each weld.

Additional rails 10 and upright members 12 comprising the panel framework 14 may be welded together by repeating the steps described above, until a integral panel has been formed. In each such instance, an upright member 12 will be transversely positioned within the rail channel 26 of the rail 10 to which it is to be secured, so that it contacts at least one, and preferably both, of the weld-forming regions 28. The upright member 12 is contacted with an electrode having a first polarity, and the rail 10 is contacted with an electrode having a second polarity opposed to the first polarity. While the rail 10 is undergoing compression as described above, a welding current is transmitted between the two electrodes to cause the weld-forming region to form a weld 36 within the rail channel 26 which joins the upright member 12 to the rail 10. After each panel is assembled as described, it is preferably provided with a polyester powder coating in order to enhance its resistance to corrosion.

The welding steps required to assembled a panel from rails 10 and upright members 12 may be performed in succession, or some or all of these steps may be performed simultaneously, preferably using a separate pair of electrodes to form each weld. For example, with the panel shown in FIG. 1, seven adjacent upright members 12 may be welded simultaneously to both the upper and lower rails 10.

The welding steps required to form a panel may advantageously be performed with automated equipment, such as a press-type welding machine. Such a welding machine may comprise one or more welding heads, each of which contains first and second electrodes which can respectively contact an upright member 12 and an associated rail 10. While current flows between the first and second electrodes, the welding machine simultaneously pressurizes the joint between the upright member 12 and rail 10. When the head is retracted, the partially assembled panel may be repositioned, so that another weld or group of welds may be formed.

With the resistance projection welding assembly method of the present invention, the welds used to assemble each panel 16 are formed internally within the rail channels 26. The exterior surfaces of the panel 16 of the present invention accordingly do not display any of the visible blemishes and marks which are characteristic of other assembly methods, such as other types of welding. In addition to its role as a weld-forming region 28 within the rail channel 26, the longitudinal ridge formed in each rail 10 also enhances the strength of the rail 10.

An apparatus 50 for assembling panels of the present invention is shown in FIGS. 7A, 7B, 8A and 8B. At its upstream end 52, shown in FIGS. 7A and 8A, the apparatus 50 comprises a upstream lift 54 capable of vertically moving a horizontal lift platform 56 between a lower position (not shown), and an upper position, shown in FIG. 8A. Preferably, the upstream lift 54 is a scissor lift. The lift platform 56 is preferably provided with a conveyor system 58, such as a roller conveyor, capable of moving a load carried by the lift platform 56 in a generally horizontal downstream direction designated by the arrow 60.

Immediately adjacent the upstream lift 54 is an elongate conveyor frame system 62 which supports an elevated horizontal assembly platform 64. Positioned above the assembly platform 64 is an elongate downstream conveyor system 66, preferably comprising a powered roller conveyor, capable of moving a load in the generally horizontal downstream direction 60. The downstream conveyor system 66 should be manually accessible from the assembly platform 64, and preferably is situated at approximately human waist height above the assembly platform 64. As shown in FIG. 8A, the vertical position of the downstream conveyor system 66 should register with the upper position of the upstream lift 54.

The conveyor frame system 62 further supports an upstream conveyor system 68, preferably comprising a powered roller conveyor. The upstream conveyor system 68 should be capable of moving a load in the generally horizontal upstream direction designated by the arrow 70, and is preferably positioned below the assembly platform 64, in underlying relationship to the downstream conveyor system 66. The vertical position of the upstream conveyor system 68 should equal that of the upstream lift 54 at its lower position.

Figure 7A:
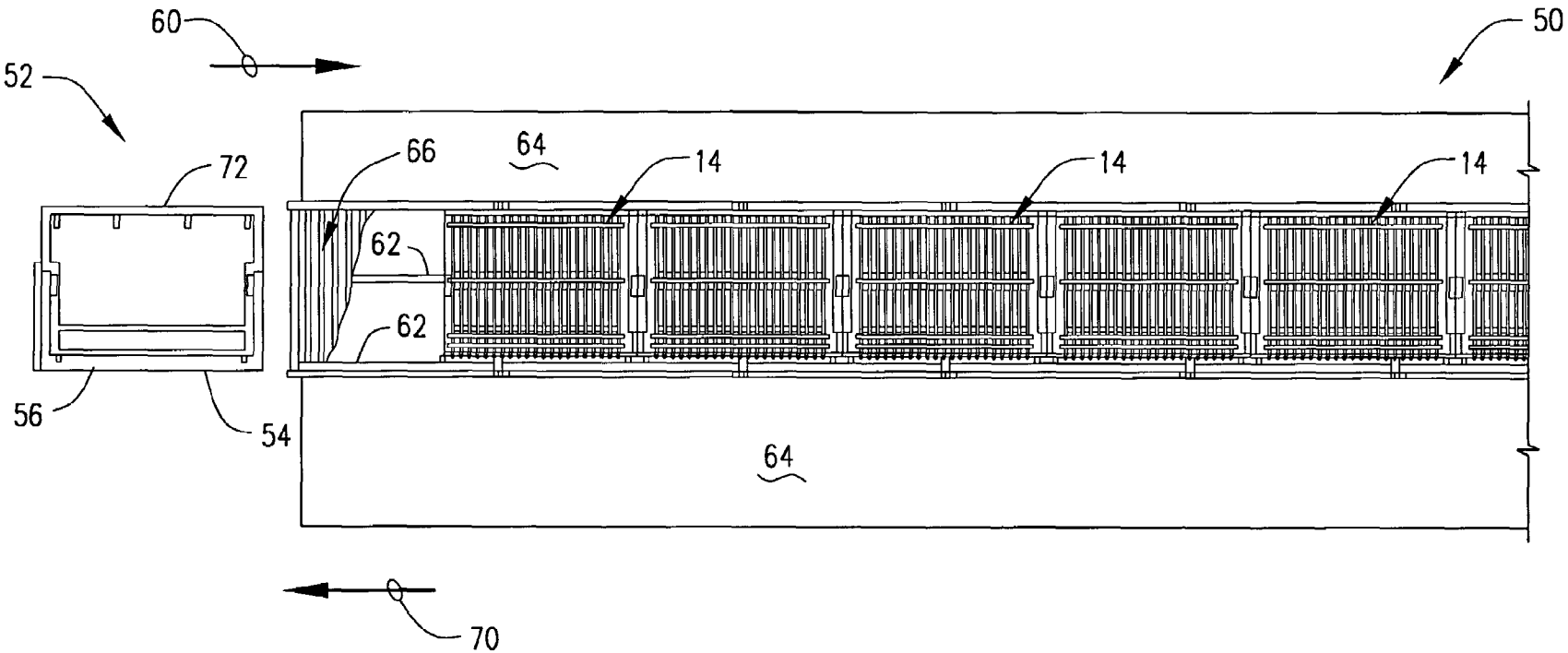
FIGS. 7A and 7B are top plan views of an apparatus for assembling panels of the present invention, with FIG. 7A showing the upstream section and FIG. 7B showing the downstream section of the apparatus. The upstream conveyor system has been partially cut away in FIG. 7A, and omitted from FIG. 7B, to permit better display of other components. For the same reason, welding stations have been omitted from FIGS. 7B and 8B, and the upper structure of the welding area cut away in FIG. 7B.

As best shown in FIG. 7A, the lift platform 56 of the upstream lift 54 is sized to receive and carry a pallet 72, which is used to assemble the panel frameworks 14 in preparation for welding. The conveyor systems 66 and 68 are similarly sized to receive and carry a plurality of spaced pallets 72. The pallets 72, which are preferably of identical construction, should be formed from a strong and durable material such as steel. Each pallet 72 preferably comprises a flat, frame-like rectangular structure having external dimensions which slightly exceed those of the panel framework 14 to be assembled in the apparatus 50.

In order to permit use of a single pallet 72 with panel frameworks 14 of more than one size, the pallet 72 may be provided with a telescoping structure, so that it may be configured with a range of widths. The upper side of each pallet 72 is preferably provided with a jig system (not shown), which guides and maintains correct positioning of rails 10 and upright members 12 in the panel framework 14.

A series of pallets 72, each typically empty, is discharged by the upstream conveyor system 68 in direction 70 onto the upstream lift 54, which is in its lower position. After each pallet 72 is received on the lift platform 56, the upstream lift 54 is actuated to move the pallet 72 to the upper position shown in FIG. 8A. Once the upstream lift 54 is in its upper position, the conveyor system 58 is actuated. The conveyor system 58 causes the pallet 72 to move in the downstream direction 60, and discharge onto the downstream conveyor system 66. The upstream lift 54 is then lowered to its lower position, and these steps are repeated for each additional pallet 72 discharged by the downstream conveyor system 68.

As best shown in FIG. 7A, a line of pallets 72, serially discharged from the upstream lift 54, is slowly advanced by the downstream conveyor system 66 in direction 60. As this occurs, workers standing on the assembly platform 64 manually assemble rails 10 and upright members 12 into a panel framework 14 on the upper side of each empty pallet 14.

Figure 7B:
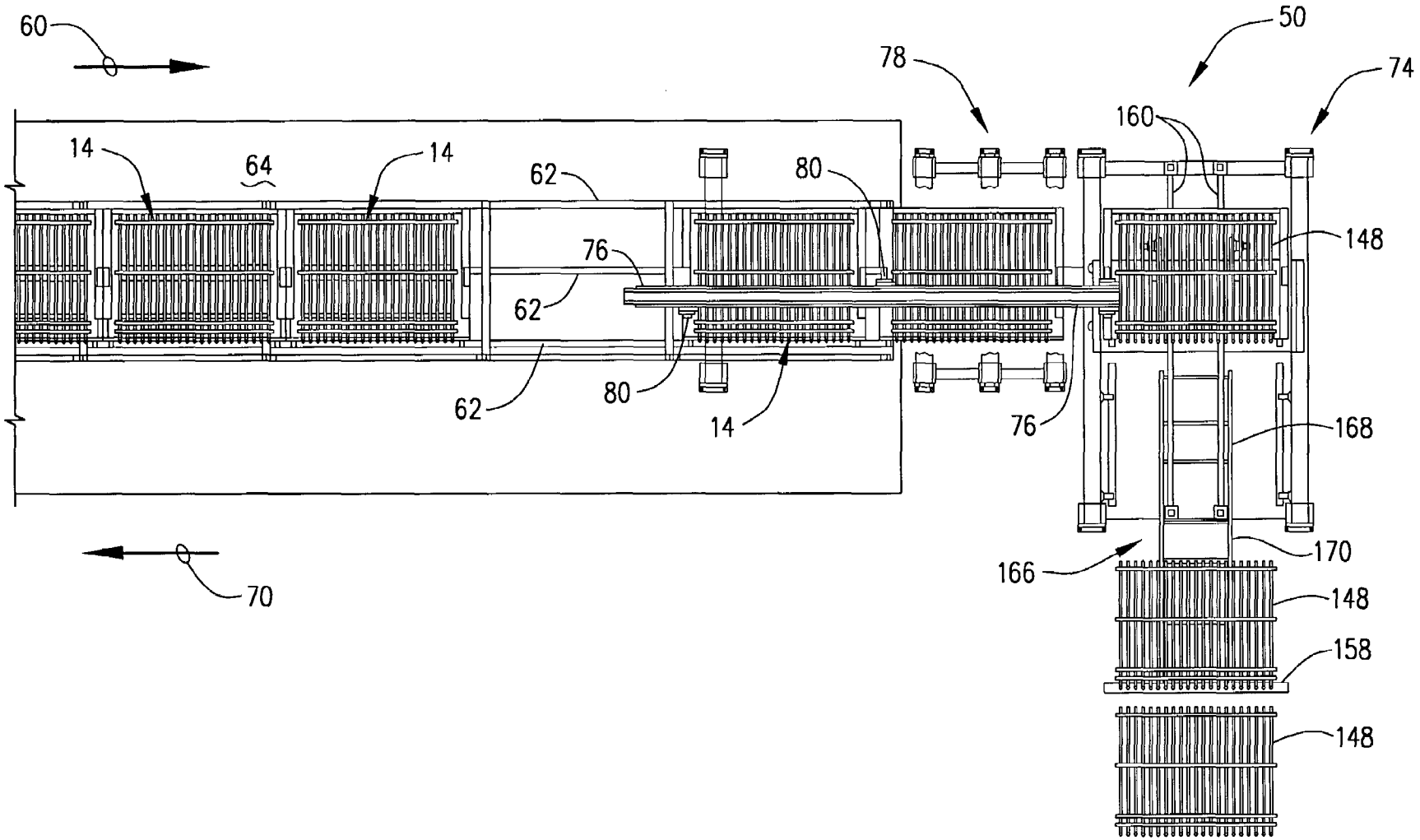
Figure 5A:
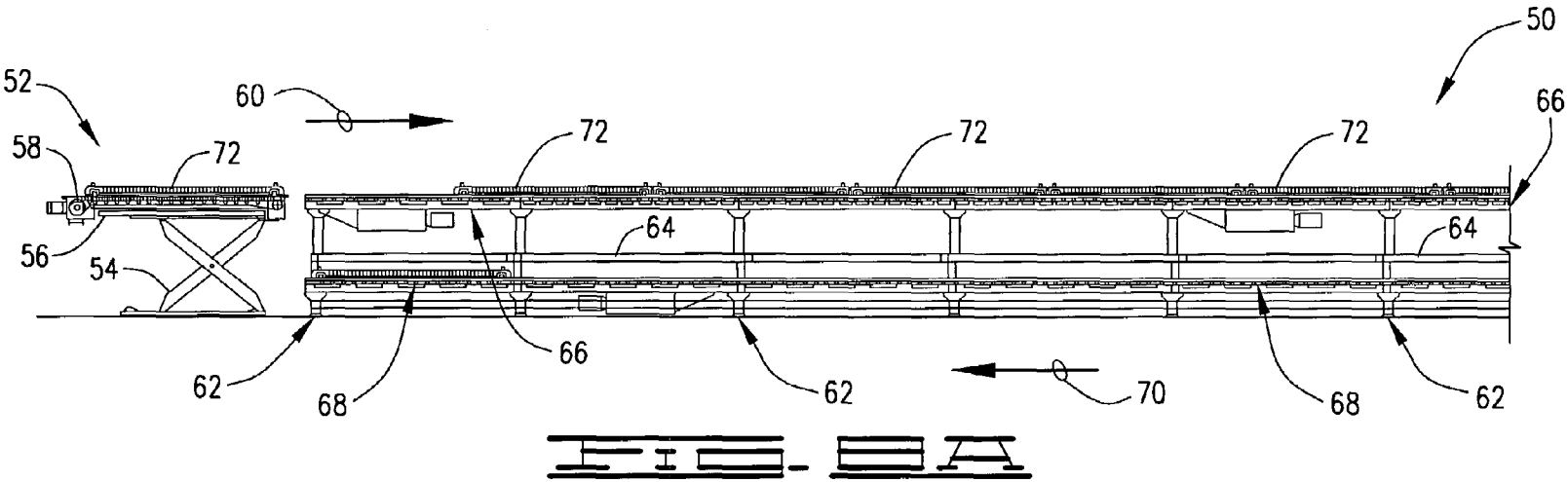
Figure 5B:
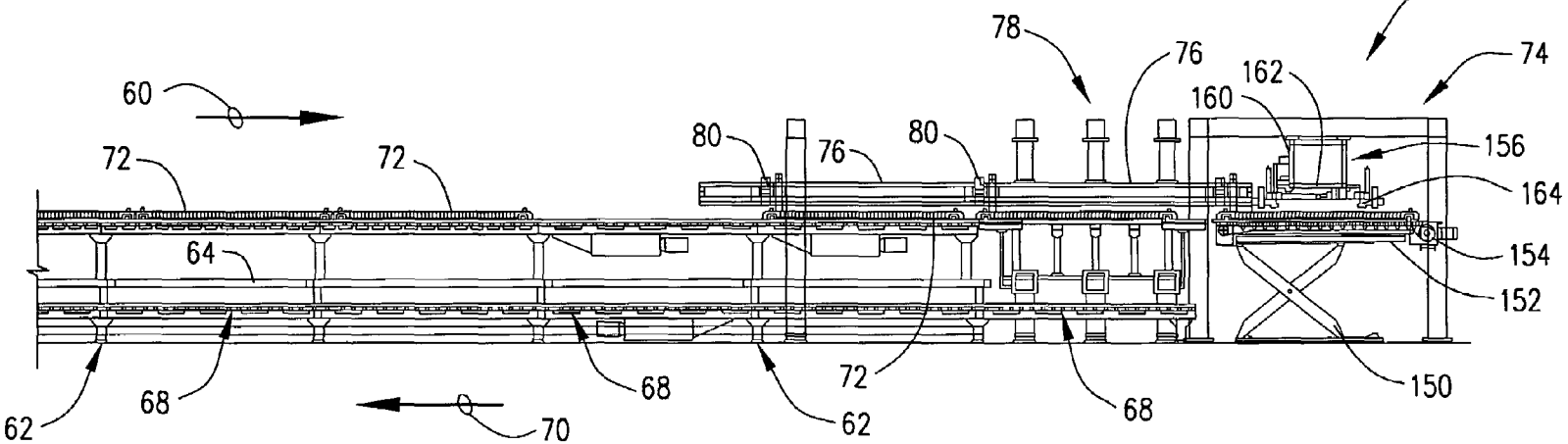
Figure 3:
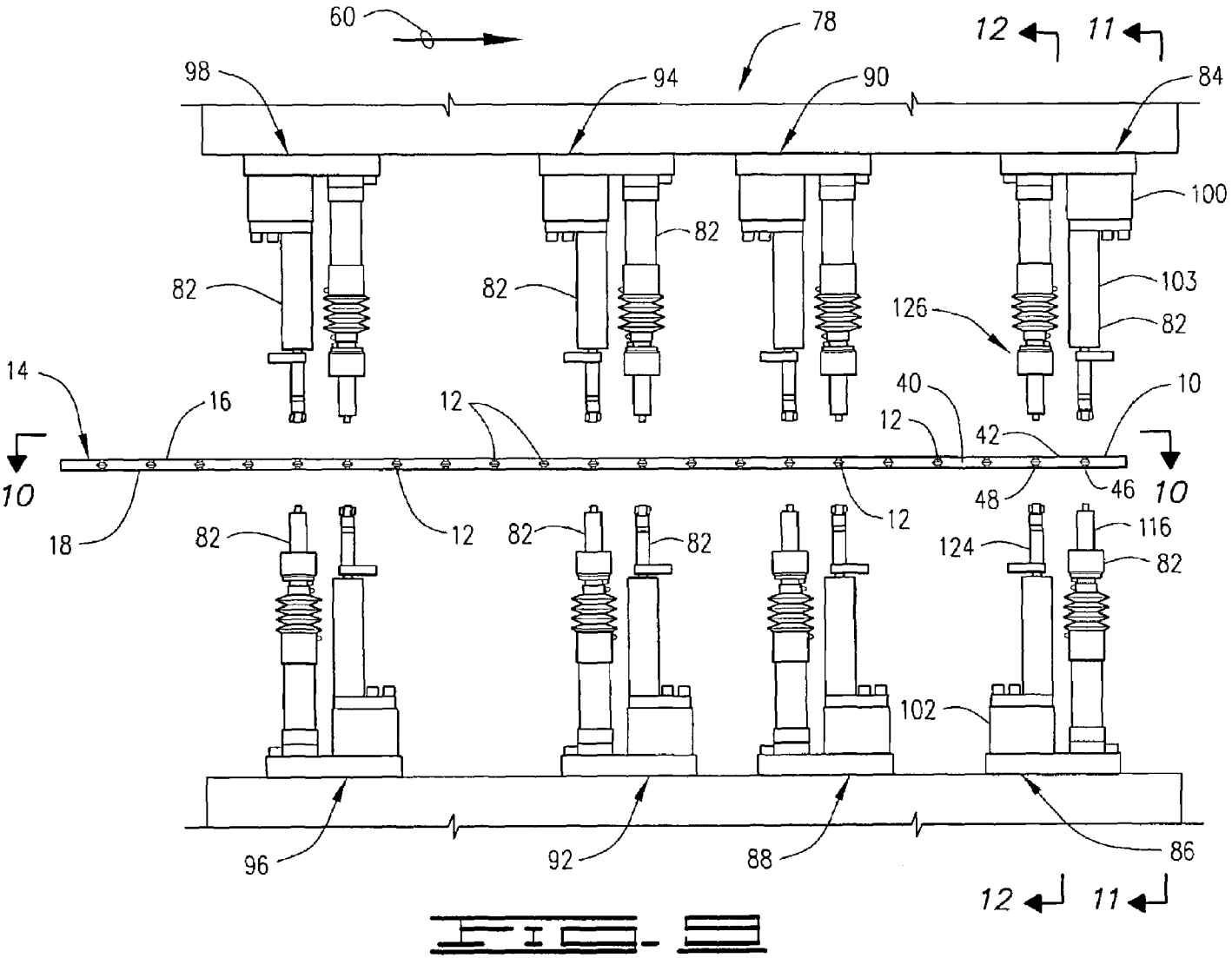

Adjacent the downstream end 74 of the apparatus 50, shown in FIGS. 7B and 8B, the downstream conveyor system 66 further comprises an elongate elevated welding gantry 76 which extends into and through a welding area 78. Two grippers 80 are supported by the welding gantry 76, preferably on longitudinally opposite sides thereof. Each gripper 80 is driven by an independent drive system, such as a chain drive, so that is movable, independently of the other gripper 80, along the full length of the welding gantry 76.

As a pallet 72 carried by the powered roller conveyor system moves beneath the welding gantry 76, one of the grippers 80 engages an upwardly projecting lug (not shown) formed on the upstream end of the pallet 72. Each pallet 72 is preferably provided with two such lugs, spaced by the same lateral distance as that separating the two grippers 80, so that either gripper 80 will have an underlying lug which it may engage on that pallet. After a gripper 80 has engaged a pallet 72, it positively moves the pallet 72 toward, and eventually into, the welding area 78.

The conveyor frame system 62 extends within the welding area 78, and is provided with rollers (not shown) which support the underside of each pallet 72 within the welding area 78. Rollers are spaced so as not to obstruct the motion of electrodes and other moving parts in the welding area 78. The rollers are preferably not powered, so that movement of the pallet 72 in the vicinity of the welding area 78 is controlled solely by the gripper 80 which engages it.

With reference to FIG. 9, the welding area 78 of the apparatus 50 comprises an area in which the panel framework 14 may be horizontally positioned in a first welding position. Situated within the welding area 78 is at least one, and preferably a plurality of welding stations 82. The plural welding stations 82 are preferably of identical construction, and are arrayed in a series of parallel rows. More preferably, the welding stations 82 are arrayed in an even number of parallel rows. In the embodiment shown in FIG. 9, the apparatus 50 features welding stations 82 arrayed a total of eight rows: a first row 84, second row 86, third row 88, fourth row 90, fifth row 92, sixth row 94, seventh row 96 and eighth row 98. Preferably the first and second rows 84 and 86 are separated by a distance equaling the spacing of adjacent upright members 12 in the panel framework 14. The third and fourth rows 88 and 90, and each successive pair of odd- and even-numbered adjacent rows, are preferably characterized by the same separation distance as the first and second rows 84 and 86.

The second and third rows 86 and 88 of welding stations are preferably separated by a greater distance than the separation of the first and second rows 84 and 86. More preferably, the separation distance of the second and third rows 86 and 88 is an integral multiple of the separation distance between adjacent upright members 12 in the panel framework 14. Preferred integral multiples are three, four and five. The fourth and fifth rows 90 and 92, and each successive pair of even- and odd-numbered adjacent rows, are preferably separated by an integral multiple of the separation distance between adjacent upright members 12 in the panel framework 14.

The separation distance between the second and third rows 86 and 88 may, but need not, equal the separation distance between each successive pair of even- and odd-numbered adjacent rows. Thus, in the embodiment shown in FIG. 9, the distance between the second and third rows 86 and 88 is three times the separation distance between adjacent upright members 12, while the fourth and fifth rows 90 and 92 are separated by four times the separation distance between adjacent upright members 12. The sixth and seventh rows 94 and 96 are separated by five times the separation distance between adjacent upright members 12.

Figure 10:
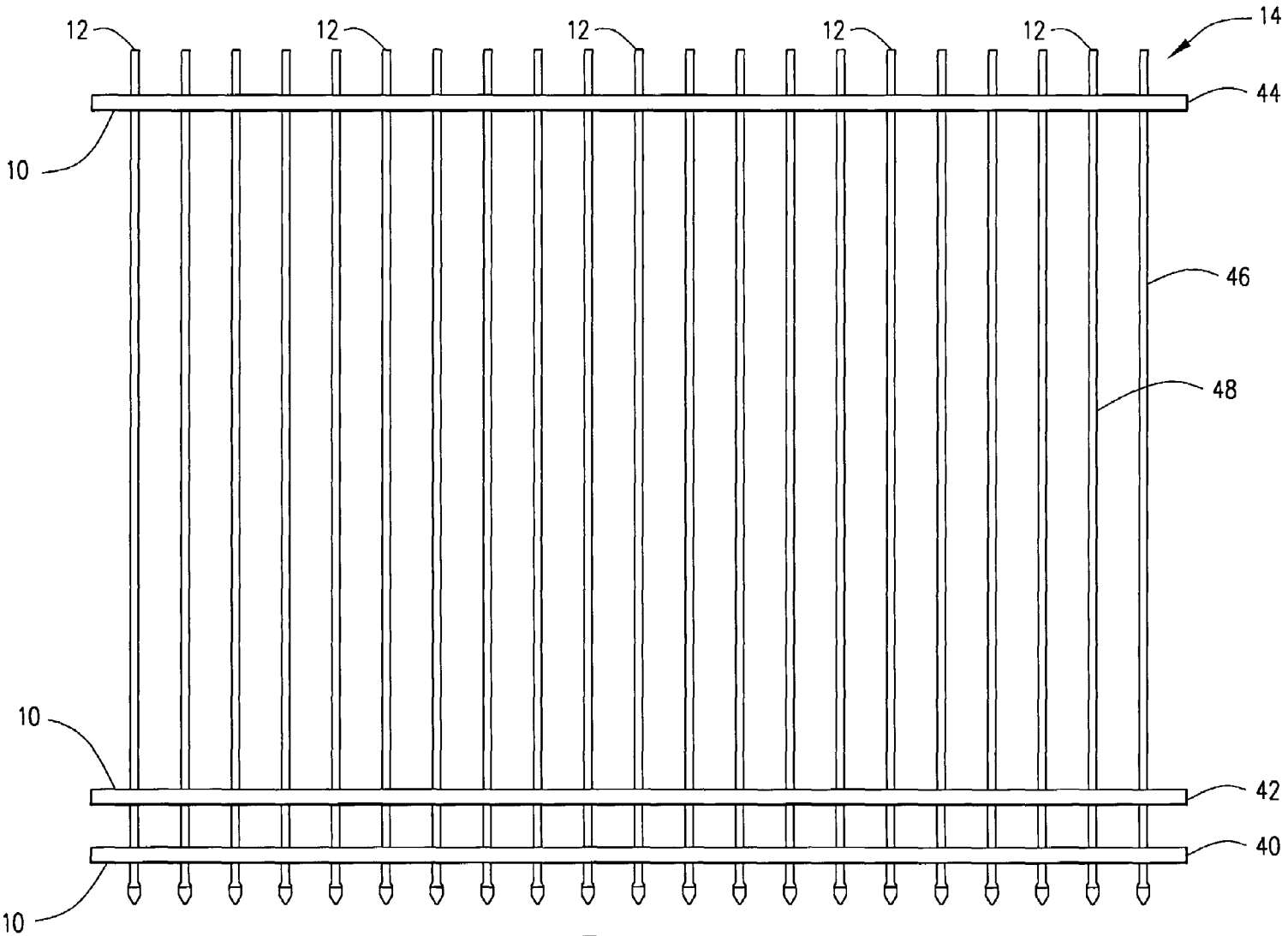
FIG. 10 is a top plan view of the panel framework shown in FIG. 9, taken along line 10-10.
Figure 7:
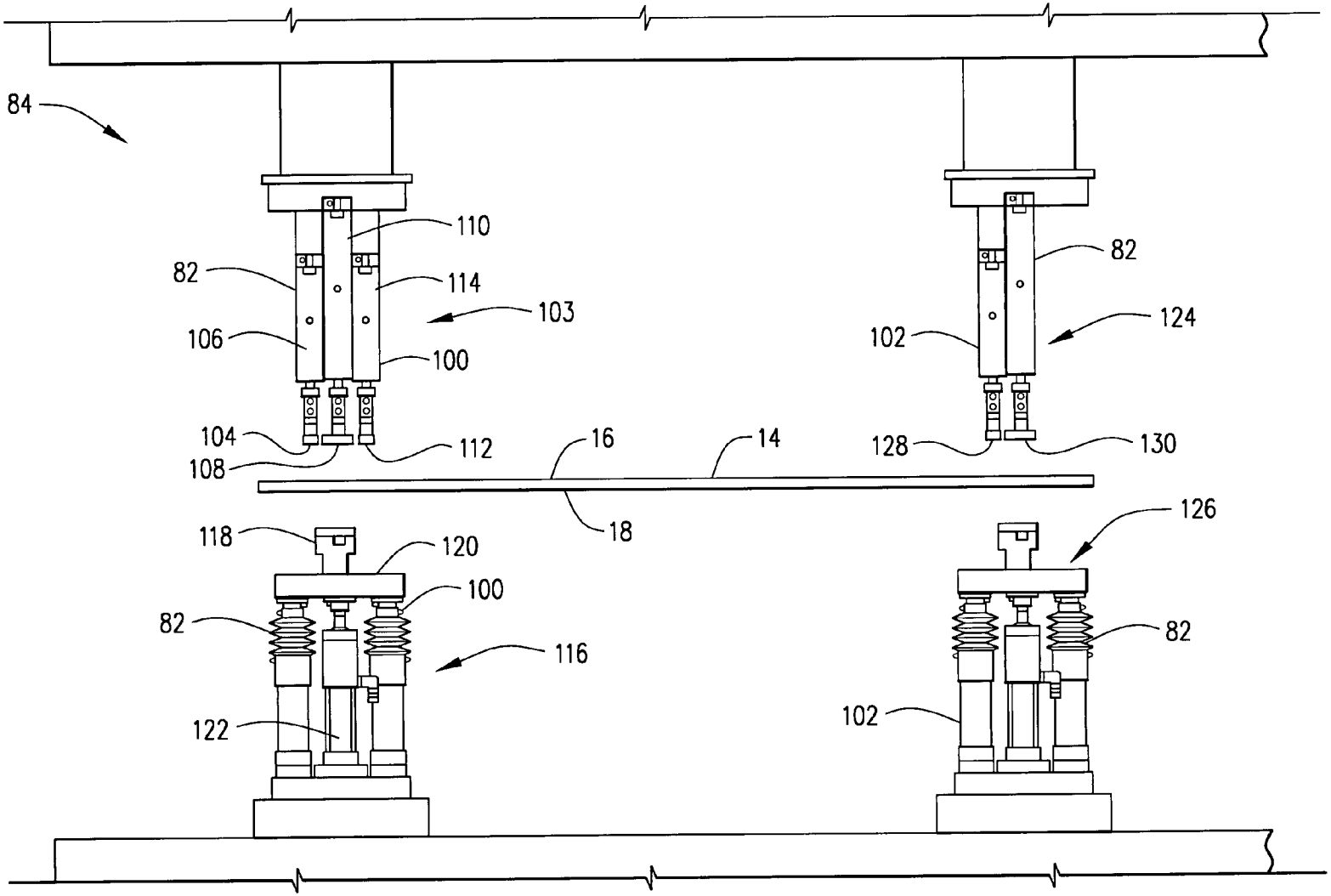

A pallet 72 carrying a panel framework 14 is moved by gripper 80 in downstream direction 60 through the welding area 78 until the first upright member 46, which is situated adjacent the leading downstream end of the pallet 72, is aligned with the first row 84 of welding stations 82. Motion of the gripper 80, and thus the pallet 72 and panel framework 14, is then halted. When the panel framework 14 has been positioned in this way, each of the other rows of welding stations will likewise be aligned with an upright member 12, as shown in FIGS. 9 and 10. This positioning of the panel framework 14 comprises a first welding position.

FIG. 11 shows the first row 84 of welding stations 80 while the panel framework 14 is in the first welding position. In the embodiment shown in the Figures, each row of welding stations 80 comprises two spaced welding stations: a first welding station 100 and a second welding station 102. The first welding station 102 comprises an electrode assembly 103 positionable adjacent the first side 16 of a panel framework 14 received in the welding area 78 at the first welding position. The electrode assembly 103 comprises a first electrode 104 having a first polarity, preferably as a result of an electrical connection to a source of welding current. The first electrode 104 is supported on, and vertically positionable by, reciprocating cylinder 106. The cylinder 106 is preferably pneumatically actuated, and should have a stroke sufficient to move the first electrode 104 into electrical contact with the first side 16 of the panel framework 14 positioned within the welding area 78 at the first welding position. In the retracted position of cylinder 106, the first electrode 104 should permit a pallet 72 to clearingly move through welding area 78 in downstream direction 60.

The electrode assembly 103 further comprises a second electrode 108 having a second polarity which is opposed to the first polarity, preferably as a result of an electrical connection to a grounded object. The second electrode 108 is situated near the first electrode 104, and is supported on, and vertically positionable by, reciprocating cylinder 110. The cylinder 110 is preferably pneumatically actuated, and should have a stroke sufficient to move the second electrode 108 into electrical contact with the first side 16 of the panel framework 14 positioned within the welding area 78 at the first welding position. In the retracted position of cylinder 110, the second electrode 108 should permit a pallet 72 to clearingly move through welding area 78 in downstream direction 60.

In some embodiments of the apparatus of the present invention, the electrode assembly will be limited to first and second electrodes and their associated motive equipment. In other embodiments, however, additional electrodes and motive equipment may be included in the electrode assembly. For example, additional electrodes may be provided in order to use a single electrode assembly to weld two or more nearby rails 10 in a panel framework 14, such as the two closely spaced first and second rails 40 and 42 in the panel framework 14 shown in FIG. 10. Thus, in the embodiment shown in the Figures, the first electrode assembly 103 further comprises a third electrode 112, which preferably has the same first polarity as the first electrode 104.

Preferably, the third electrode 112 is electrically connected to the same source of welding current as the first electrode 104. The third electrode 112 is situated near the second electrode 108, preferably on the side thereof opposite the first electrode 104. The center-to-center spacing of the third electrode 112 from the first electrode 104 should equal the spacing of the pair of rails 40 and 42 to be welded by the electrode assembly 103.

The third electrode 112 is supported on, and vertically positionable by, reciprocating cylinder 114. The cylinder 114 is preferably pneumatically actuated, and should have a stroke sufficient to move the third electrode 112 into electrical contact with the first side 16 of the panel framework 14 positioned within the welding area 78 at the first welding position. In the retracted position of cylinder 114, the third electrode 112 should permit a pallet 72 to clearingly move through welding area 78 in downstream direction 60.

The first welding station 100 further comprises an anvil assembly 116, positioned in opposition to the electrode assembly 103, which functions to bracingly engage the second side 18 of the panel framework 14. Such bracing engagement assists in maintaining the position of the panel framework 14 as the electrode assembly 103 engages the first side 16 of the panel framework.

The anvil assembly 116 comprises an anvil 118, formed from a strong and conductive material such as copper bus bar, which is positioned adjacent the second side 18 of the panel framework 14. The anvil 118 is carried by a platform 120 which is in turn is supported on, and vertically positionable by, reciprocating cylinder 122, which is preferably pneumatically actuated and self-locking.

Cylinder 122 should have a stroke sufficient to move the anvil 118 into bracing mechanical engagement with the second side 18 of a panel framework 14 positioned within the welding area 78 at the first welding position. In the retracted position of cylinder 122, the anvil assembly 116 should permit a pallet 72 to clearingly move through welding area 78 in downstream direction 60. Components of the anvil assembly 116 should be electrically grounded.

With continued reference to FIG. 11, the second welding station 102 in the first row 84 comprises an electrode assembly 124 positionable adjacent the first side 16 of a panel framework 14 in the welding area 78 at the first welding position. The second welding station 102 further comprises an anvil assembly 126, which is positioned in opposition to the electrode assembly 124 and functions to bracingly engage the second side 18 of the panel framework 14. The anvil assembly 126 is preferably identical in construction to anvil assembly 116.

In the embodiment shown in the Figures, the electrode assembly 124 includes a first electrode 128, a second electrode 130, and associated cylinders, which are identical in all respects to the first electrode 104, second electrode 108 and associated cylinders 106 and 110, described with reference to the first welding station 100. In the embodiment shown in the Figures, the second welding station 102 is used to weld only one rail, the third rail 44. A third electrode, and associated motive equipment, are accordingly not required for this embodiment. If justified by the rail configuration of the panel framework, additional electrodes and motive equipment may be included in the second welding station, in the same manner as described with reference to the first welding station 82.

The separation distance between the first electrode 104 and the first electrode 128 should equal the separation distance between the uppermost and lowermost rails of the panel framework 14. This separation corresponds to the distance between first rail 40 and third rail 44 in the panel framework 14 shown in FIG. 10. In some embodiments of the apparatus of the present invention, either or both of the welding stations 100 and 102 may be movable along an horizontal axis perpendicular to downstream direction 60. Such movability can facilitate use of the same apparatus with panel frameworks of more than one size and/or rail configuration.

Figure 12:
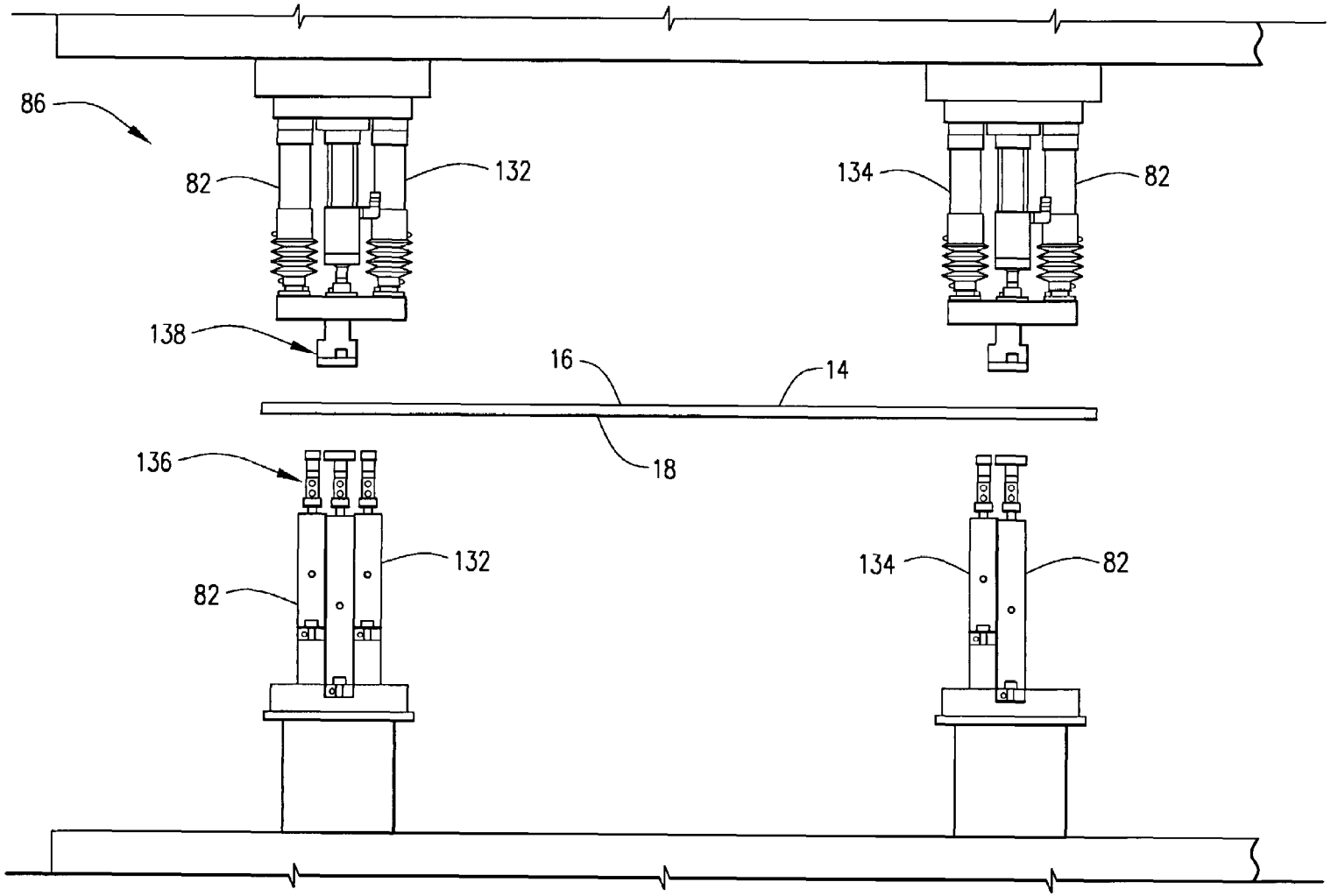
FIG. 12 is a side cross-sectional view of the welding section and panel framework shown in FIG. 9, taken along line 12-12, showing a portion of the second row of welding stations and a partially assembled panel framework in the first welding position.

FIG. 12 shows the second row 86 of welding stations, which preferably comprises first welding station 132 and second welding station 134. The first welding station 132 is preferably identical in construction to the adjacent first welding station 100 of the first row 84, but is inverted with reference to the panel framework 14 in its first welding position. Thus, the electrode assembly 136 of first welding station 132 is positioned adjacent the second side 18 of the panel framework 14, while the opposed anvil assembly 138 is positioned adjacent the first side 16. The second welding station 134 is preferably identical in construction to the adjacent second welding station 102 of the first row 84, but is similarly inverted with reference to the panel framework 14 in its first welding position.

As shown in FIG. 9, first and second welding stations 82 are provided for the remaining rows and preferably are identical in construction to those described with reference to the first and second rows 84 and 86. Moreover, in the third and fourth rows 88 and 90, and in every other adjacent pair of odd- and even-numbered rows, first welding stations in the paired rows preferably have the same inverted relationship described with reference to the first and second rows 84 and 86. Second welding stations in these paired rows likewise have the same inverted relationship described with reference to the first and second rows 84 and 86.

In the embodiment shown in the Figures, two welding stations are provided for the first row 84, second row 86, and for each additional row of welding stations 82 in the apparatus 50. In general, the preferred number of welding stations provided for each row will be dictated by the rail configuration of the panel framework to be processed in the welding area. The number of such welding stations is preferably sufficient to permit these stations to weld every rail to be attached to an upright member in alignment with that row. If needed to accomplish this objective, additional welding stations may be provided for each row. Third and subsequent welding stations in adjacent pairs of odd- and even-numbered rows, preferably have the same inverted relationship described with reference to the first and second welding stations.

Figure 13:
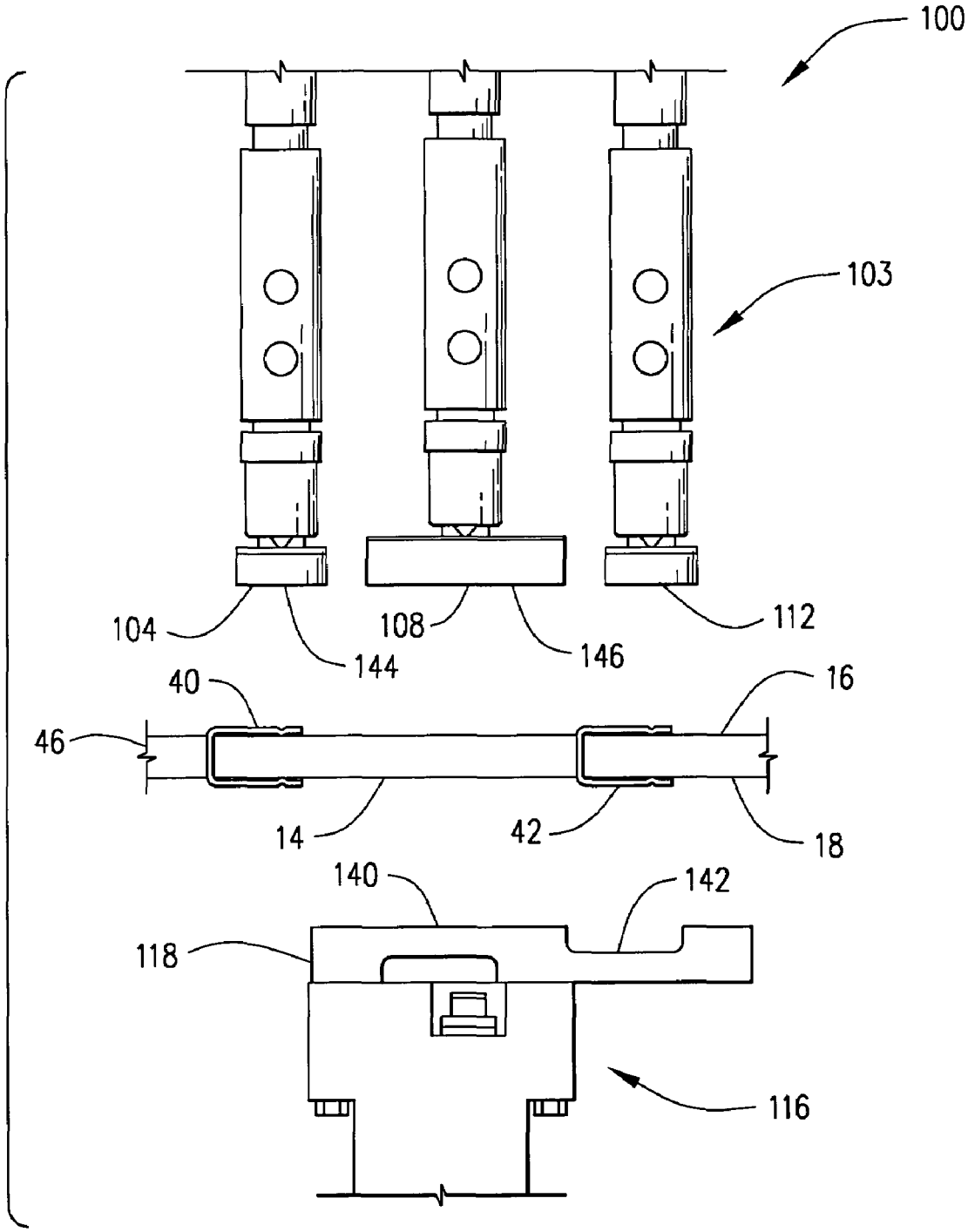
FIG. 13 is an enlarged side view of the first welding station shown in FIG. 9, showing a partially assembled panel framework positioned in the first welding position.

FIG. 13 is an enlarged view showing the configuration of the first welding station 100 of the first row 84. The electrode assembly 103 and the anvil assembly 116 initially are in their retracted positions, thereby permitting free movement of the panel framework 14 and its supporting pallet (not shown) to the first welding position shown in FIG. 13. In this position, the leading downstream first upright member 46 of the panel framework 14 is positioned in underlying relationship to the electrodes the electrode assemblies 103, and in overlaying relationship to the anvil assembly 116, as FIG. 9 illustrates. The first rail 40 is positioned in underlying relationship to the first electrode 104, while the second rail 42 is positioned in underlying relationship to the third electrode 112.

Figure 14:
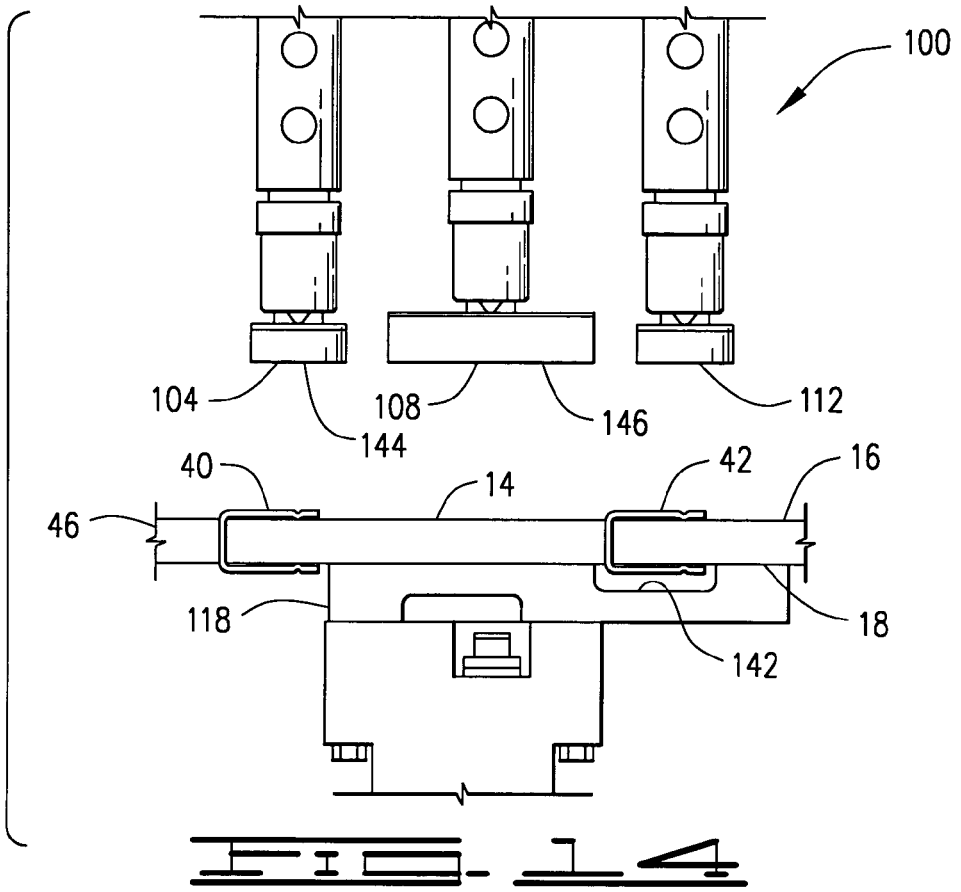
FIG. 14 shows the welding station of FIG. 13 at the next stage of the welding process, with the anvil in bracing engagement with the panel framework.

In the next stage of the welding process, shown in FIG. 14, the anvil assembly 116 extends to bracingly engage the second side 18 of the panel framework 14. The substantially flat bed 140 of the anvil 118 is sized and positioned so as to engage the panel framework 14 at first upright member 46, without contacting either of the rails 40 and 42. To this end, a depression 142 is formed in bed 140, so that the anvil 118 maintains clearance with second rail 42 when brought into engagement with the panel framework 14. The clearing relationship between the anvil 118 and rails 40 and 42 protects against unwanted shunting of welding current applied to these rails.

Figure 15:
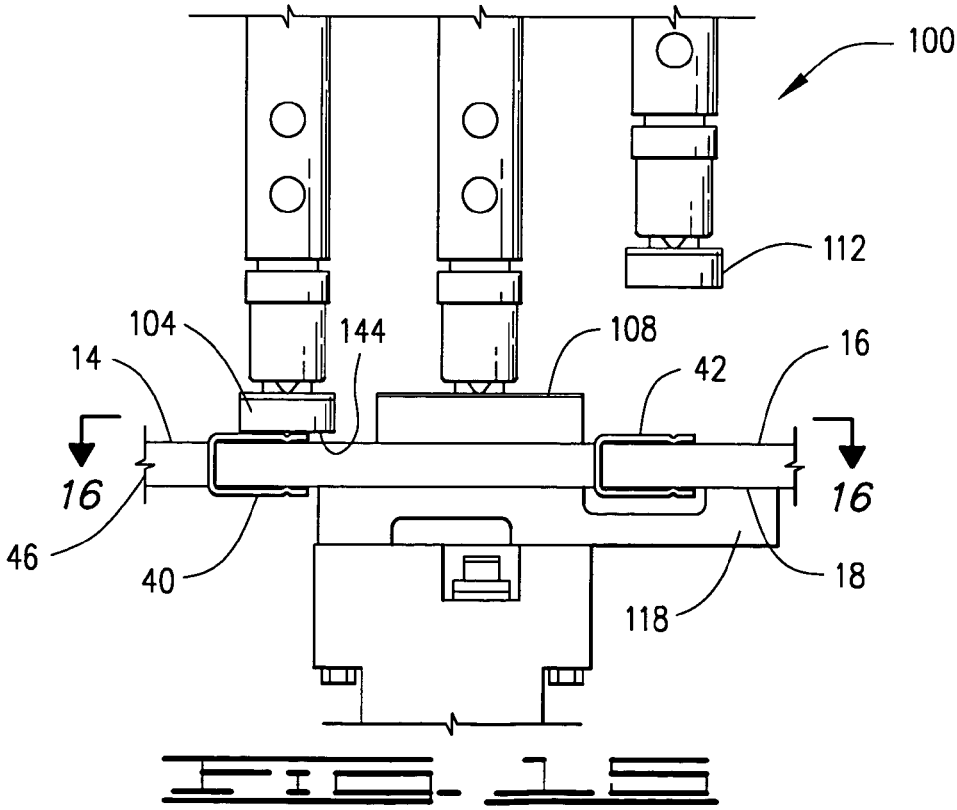
FIG. 15 shows the welding station of FIG. 14 at the next stage of the welding process, with the first and second electrodes contacting the panel framework.
Figure 16:
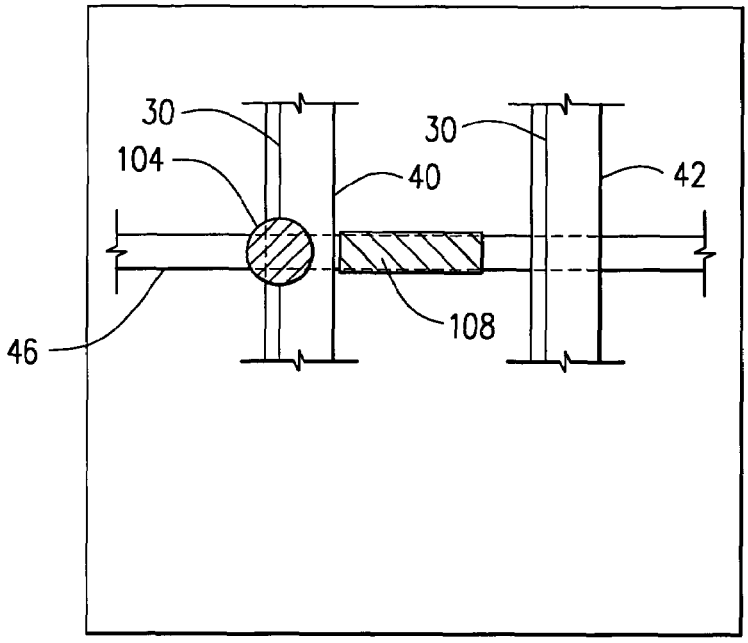
FIG. 16 is a cross-sectional view of the welding station shown in FIG. 15, taken along line 16-16, showing the position of the first and second electrodes in relation to the panel framework.

In the next stage of the welding process, shown in FIGS. 15 and 16, the second electrode 108 and the first electrode 104 are moved into contact with the first side 16 of the panel framework 14. Preferably, the second electrode 108 is first brought into contact within the first side 16, followed by the first electrode 104. Once both electrodes 104 and 108 are in contact with the first side 16, a welding current is transmitted between the first and second electrodes 104 and 108 to cause the weld-forming region 28 in the first rail 40 to form a weld within the rail channel 26. This weld joins the first upright member 46 to the first rail 40.

As shown in FIG. 16, the first electrode 104 contacts panel framework 14 at a first contact position on the first rail 40, while the second electrode 108 contacts the first upright member 46 at a second contact position between the rails 40 and 42. The surface 144 of the first electrode 104 which contacts the first rail 40 is preferably flat and circular. The diameter or width of the surface 144 is preferably at least about 75%, and more preferably 100%, of the width of the side wall of the first rail 40. In one preferred embodiment of the panel framework using rails having a side wall width of 1.25 inches, the first electrode 104 is characterized by a diameter of 1.25 inches. Such sizing of the first electrode 104 assures that welding current density will not be not so great as to cause external melting of the rail 40. Such melting can result in externally visible blemishes or marks.

Preferably, the first electrode 104 is positioned so that its longitudinal axis intersects the longitudinal score 30 formed in the first rail 40, so that the center of surface 144 overlays the score 30. Such positioning of the first electrode 104 serves to focus current flow on the weld-forming region 28 which underlies the score 30, thereby minimizing unwanted shunting of welding current.

The surface 146 of the second electrode 108 which contacts the first upright member 46 is preferably flat and rectangular. The width of surface 146 is preferably at least about 75%, and more preferably at least 100%, of the width of first upright member 46. The length of surface 146 is preferably between about 2.5 and about 5 times its width. In one preferred embodiment of the panel framework using upright members having a square cross-section with a side of 0.60 inches, the second electrode 108 is characterized by a width of 0.75 inches, and a length of 2.75 inches. Such sizing of the second electrode 108 assures that welding current density will not be not so great as to cause external melting of the first upright member 46.

The side-by-side placement of the first and second electrodes 104 and 108 enables a step welding process to occur at the weld-forming region 28. In this regard, the lateral spacing of the first electrode 104 and the second electrode 108 is preferably no greater than required to permit transmission of a weldingly effective current through the weld-forming region 28, without excessive current shunting. In a preferred embodiment using a first electrode 104 having surface 144 a diameter of 1.25 inches, and a second electrode having a rectangular surface length of 2.75 inches, the lateral spacing between the first and second electrodes 104 and 108, measured between their respective centers, is preferably between about 2 and about 3 inches, and more preferably about 2.5 inches.

Figure 17:
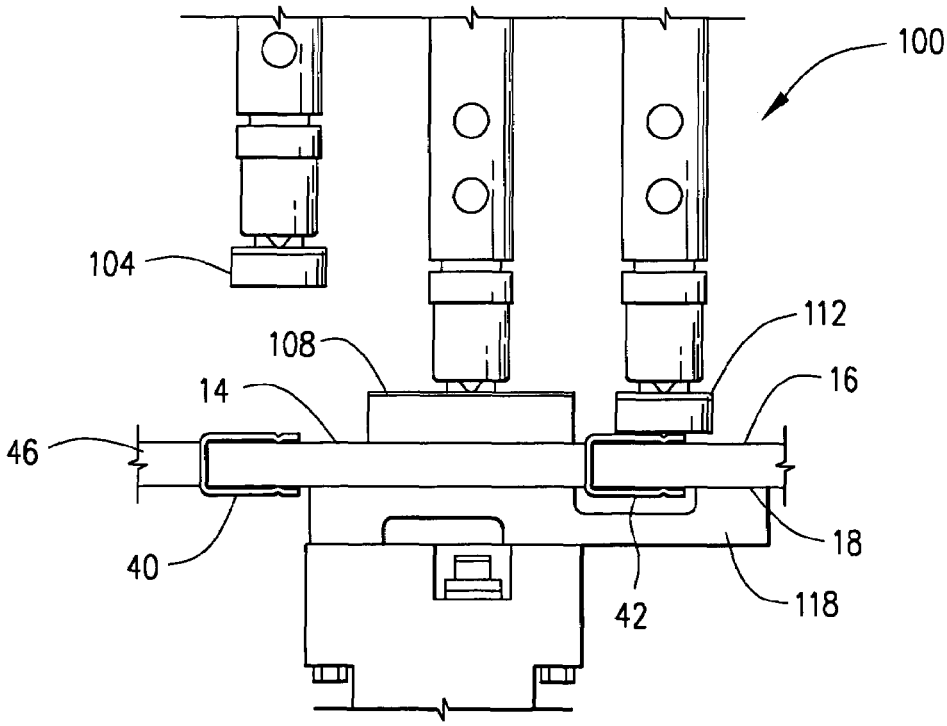
FIG. 17 shows the welding station of FIGS. 15 and 16 at the next stage of the welding process, with the second and third electrodes contacting the panel framework.

The next stage of the welding process relates only to welding stations, like the first welding station 100, which have more than two electrodes. In this stage, shown in FIG. 17, the second electrode 108 maintains contact with the first side 16 of the panel framework 14. The first electrode 104 is withdrawn, and the third electrode 112 is moved into contact with the first side 16. Once both electrodes 108 and 112 are in contact with the first side 16, a welding current is transmitted between the third and second electrodes 112 and 108, causing the weld-forming region 28 in the second rail 42 to form a weld within the rail channel 26. This weld joins the first upright member 46 to the second rail 42. The sizing and positioning of the third electrode 112 in relation to the second rail 42 is preferably identical to that described with reference to the first electrode 104 and the first rail 40. Similarly, the lateral spacing between the third electrode 112 and second electrode 108 is preferably identical to that described with reference to the first electrode 104 and second electrode 108.

In the final stage of the welding process at first welding station 100, the electrode assembly 103 and anvil assembly 116 are withdrawn, thereby returning the first welding station 100 to the configuration shown in FIG. 13. With the first welding station 100 so configured, the panel framework 14 and its supporting pallet (not shown) are once again free to move in downstream direction 60.

At the second welding station 102 of the first row 84, the same steps are carried out with the first and second electrodes 128 and 130, anvil assembly 126, first upright member 46 and third rail 44, as were described with reference to the corresponding components of the first rail station 100, first upright member 46 and the first rail 40. The placement of the first and second electrodes 128 and 130, in relation to the first upright member 46 and third rail 44, is the same as previously described with reference to first and second electrodes 104 and 108, first upright member 46 and first rail 40.

In the embodiment shown in the Figures, the second rail station 102 lacks a third electrode. Accordingly, in this embodiment, the steps relating to the third electrode, described with reference to the first welding station 100, are omitted at the second welding station 102. Preferably, corresponding steps of the welding process which occur in the first and second welding stations 100 and 102, and in any other welding stations in the first row 84, are performed simultaneously.

As FIG. 9 illustrates, other upright members 12 of the panel framework 14 are aligned with other rows of welding stations 82 while the panel framework 14 is in its first welding position. Thus, the second upright member 48, which is disposed immediately adjacent first upright member 46 is aligned with first and second welding stations 132 and 134 of the second row 86. Other upright members 12 are aligned with the welding stations of rows 88-98.

The same welding steps described with reference to the welding stations of the first row 84 are preferably performed by the corresponding welding stations of the second row 86, with one exception. Because of the inverted relationship of the welding stations of the first and second rows 84 and 86, the electrode assemblies of the second row 86 will contact the second side 18 of the panel framework, while the anvil assemblies of the second row 86 will contact the first side 16. Aside from this transposition, the welding steps performed by welding stations in the second row 86 are identical to those performed by corresponding welding stations in the first row 84.

In order to enhance speed of assembly, the welding steps performed by welding stations of the first row 84 are carried out simultaneously with corresponding welding steps performed by welding stations of the second row 86. The inverted relationship between the first and second row welding stations permits simultaneous welding to be performed on adjacent upright members 12 without excessive current shunting.

The same welding steps described with reference to the welding stations of the first row 84 and second row 86, are preferably performed in every other adjacent pair of odd- and even-numbered rows of welding stations. The welding steps performed in these adjacent pairs of rows are preferably carried out simultaneously with the corresponding welding steps performed in the first and second rows 84 and 86.

With continued reference to FIG. 9, once the upright members 12 underlying the welding stations 82 have been completely welded as described above, the pallet 72 bearing the panel framework 14 is moved by the gripper 80 in downstream direction 60 to a second welding position, in which one or more unwelded upright members 12 are positioned in alignment with one or more of the rows of welding stations 82. The same welding steps are performed by the welding stations on these unwelded upright members 12 are were previously described with reference to the first welding position. The pallet 72 is then preferably moved by the gripper 80 in downstream direction 60 to a third welding position, in which the same welding steps are performed again, if necessary. The pallet 72 is moved downstream to additional successive welding positions until all upright members 12 comprising the panel framework 14 have been completely welded.

In the embodiment shown in FIG. 9, the upright members 12 comprising the panel framework 14 may be completely welded by positioning it at first, second and third welding positions. The second welding position is reached by moving the panel framework 14 downstream from the first welding position by twice the separation distance between adjacent upright members 12. The third welding position is reached by moving the panel framework 14 downstream from the second welding position by the same distance.

When the adjacent pairs of odd- and even-numbered rows of welding stations 82 are not uniformly spaced from adjoining other such pairs, as in the embodiment shown in the Figures, some welding stations will be not needed for certain welding positions. For example, in the embodiment shown in FIG. 9, the welding stations of the second, third and four rows 86-90 should not be used while the panel framework 14 is in the third welding position, because the upright members aligned with these stations have already been welded while the panel framework 14 was at the first or second welding positions.

Once the pallet 72 has been moved through a sufficient number of welding positions to complete the welding steps described above, the gripper 80 moves the pallet 72, now bearing an integral welded panel 148, in downstream direction 60 out of the welding area 78, as shown in FIG. 7B. As this occurs, the other gripper 80, positioned adjacent the upstream end of gantry 76, moves the adjacent upstream pallet 72, bearing another panel framework 14, into the welding area 78. After the next adjacent upstream pallet 72 arrives in the welding area 78, the above-described welding steps are repeated.

Figure 20:
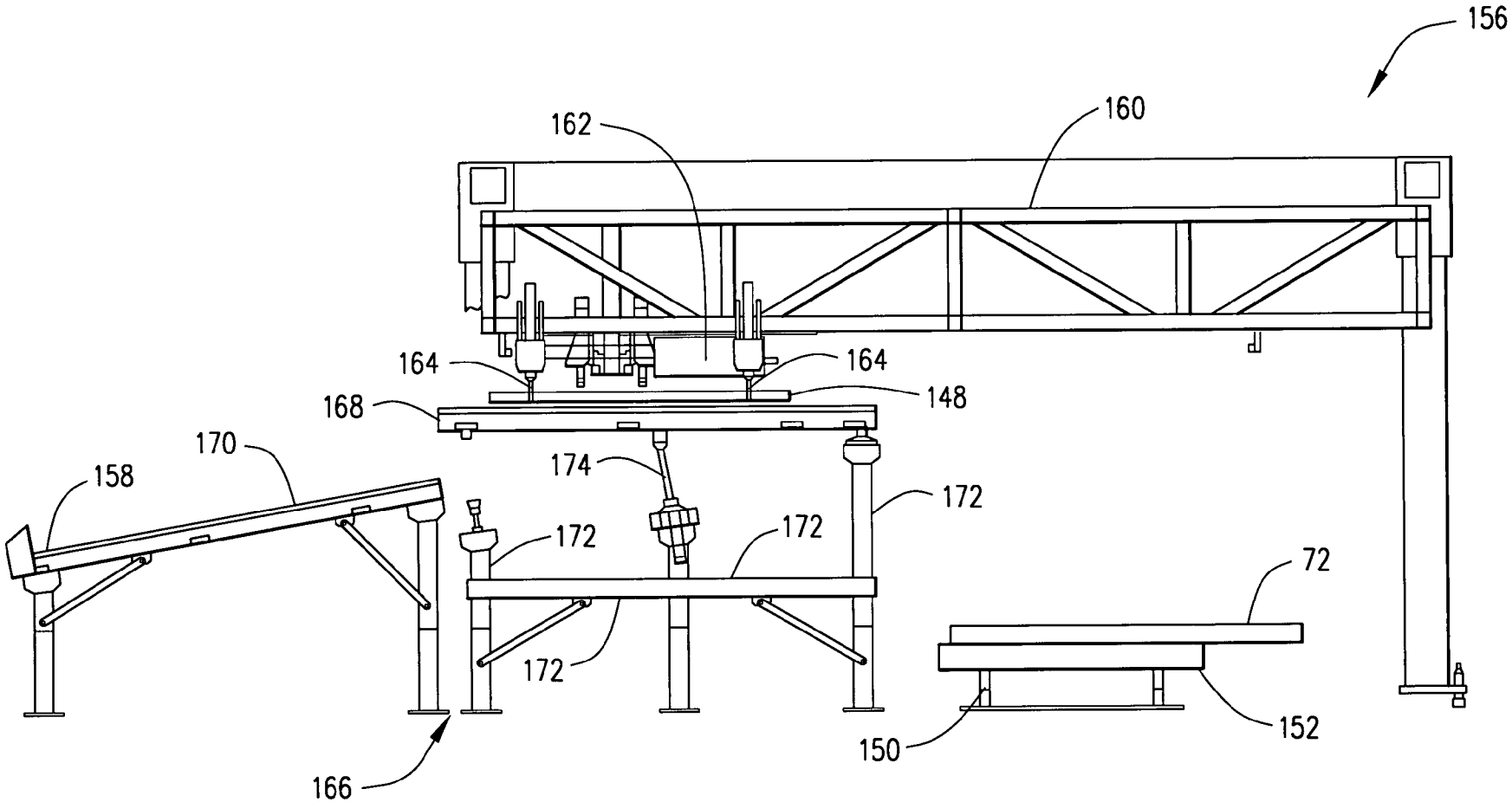
FIG. 20 is a side view showing the output conveyor system, output ramp system and downstream lift shown in FIG. 18, with the output conveyor system in its unloading position, the output ramp system in its raised position, and the downstream lift in its lower position.

As best shown in FIGS. 8B and 18, the apparatus 50 of the present invention further comprises a downstream lift 150 capable of vertically moving a horizontal lift platform 152 between an upper position, shown in FIGS. 8B and 18, and a lower position, shown in FIG. 20, which registers with the downstream conveyor system 68. Preferably, the downstream lift 150 is a scissor lift. The lift platform 152 is preferably provided with a conveyor system 154, such as a powered roller conveyor, capable of moving a load carried by the lift platform 152 in the generally horizontal upstream direction designated by the arrow 70.

Figure 22:
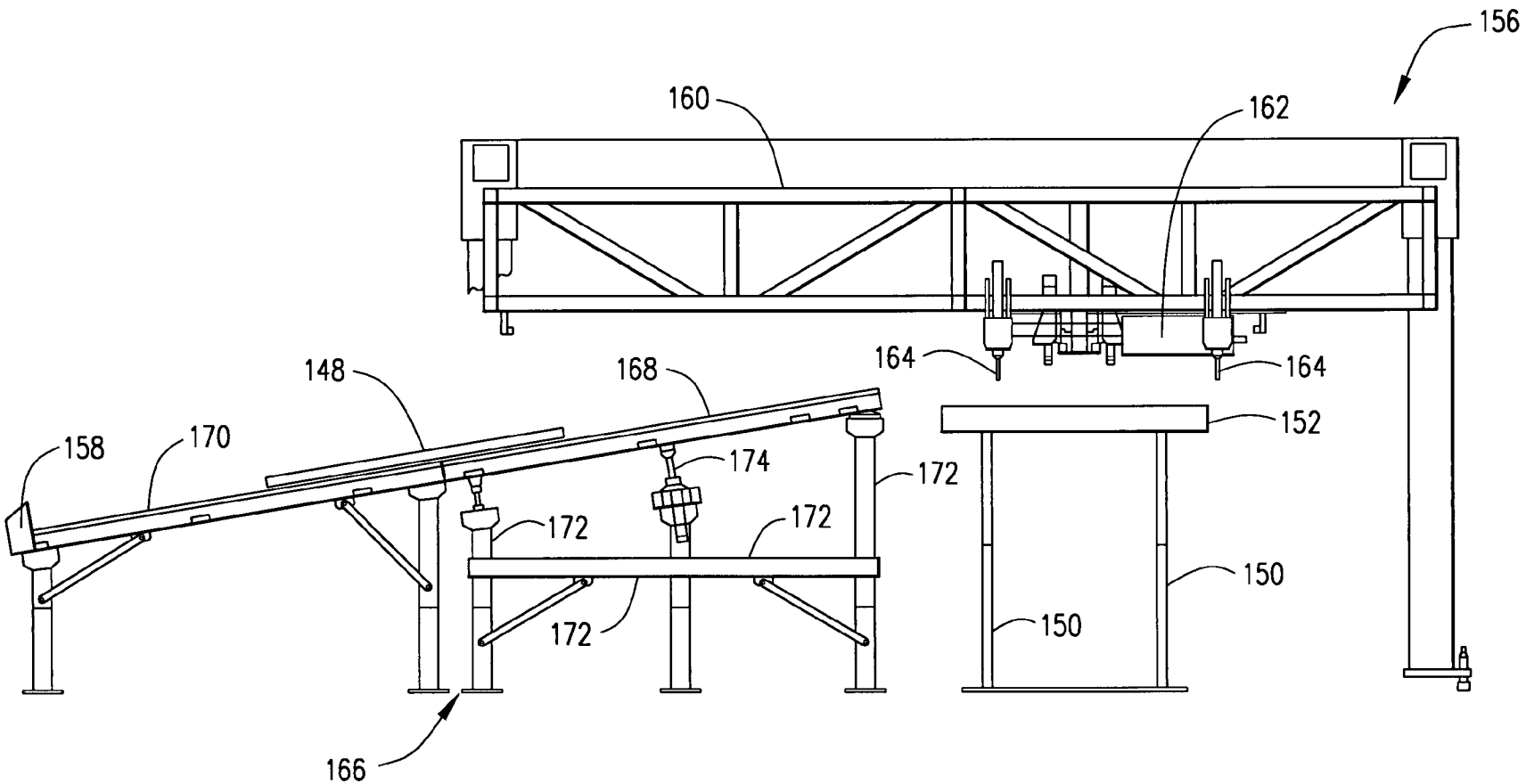
FIG. 22 is a side view showing the output conveyor system, output ramp system and downstream lift shown in FIGS. 18 and 19, in which the output conveyor system has returned to its unloading position, while the output ramp system remains in its lowered position, and the downstream lift has returned to its raised position.

The apparatus 50 preferably further comprises an output conveyor system 156, best shown in FIGS. 18, 20 and 22, which collects finished panels 148 discharged from the welding area 78 and transfers these panels 148 to an output site 158, at which panels 148 may be collected for shipment or storage. The output conveyor system 156 comprises an elongate output gantry 160, situated above the downstream lift 150. The output gantry 160 should extend in a substantially horizontal direction, and preferably is disposed in orthogonal relationship to the upper and lower conveyors 66 and 68 and the welding gantry 76.

Further comprising the output conveyor system 156 is a carriage 162 which is supported by, and longitudinally movable on the output gantry 160 between a loading position, shown in FIG. 18, and an unloading position, shown in FIG. 20. In its loading position, the carriage 162 is positioned in overlying relationship to the lift platform 152 of the downstream conveyor 150.

Supported by the carriage 162 are a plurality of grippers 164, preferably four in number, which are disposed in spaced relationship about the base of the carriage 162. The grippers 164 are preferably movable, such as by rotation, between a retracted mode and an extended mode. While the downstream lift 150 is in its upper position, shown in FIG. 18, the carriage 162 may be moved to its loading position, which immediately overlays the pallet 72. In this configuration of the apparatus 50, the grippers 164, while retracted, closely clear pallet 72. In their extended mode, however, the grippers 164 may releasably grasp and suspend a panel 148 carried by pallet 72.

The output conveyor system 156 further comprises an output ramp system 166, which functions to transfer a panel 148 discharged from the carriage 162, at its unloading position, to the output site 158. The output ramp system 166, which is best shown in FIGS. 7B, 18, 20 and 22, preferably comprises an upper ramp 168 and a lower ramp 170. The upper ramp 168 collects a panel 148 from the carriage 162 and discharges it onto the lower ramp 170, which terminates at the output site 158.

Figure 21:
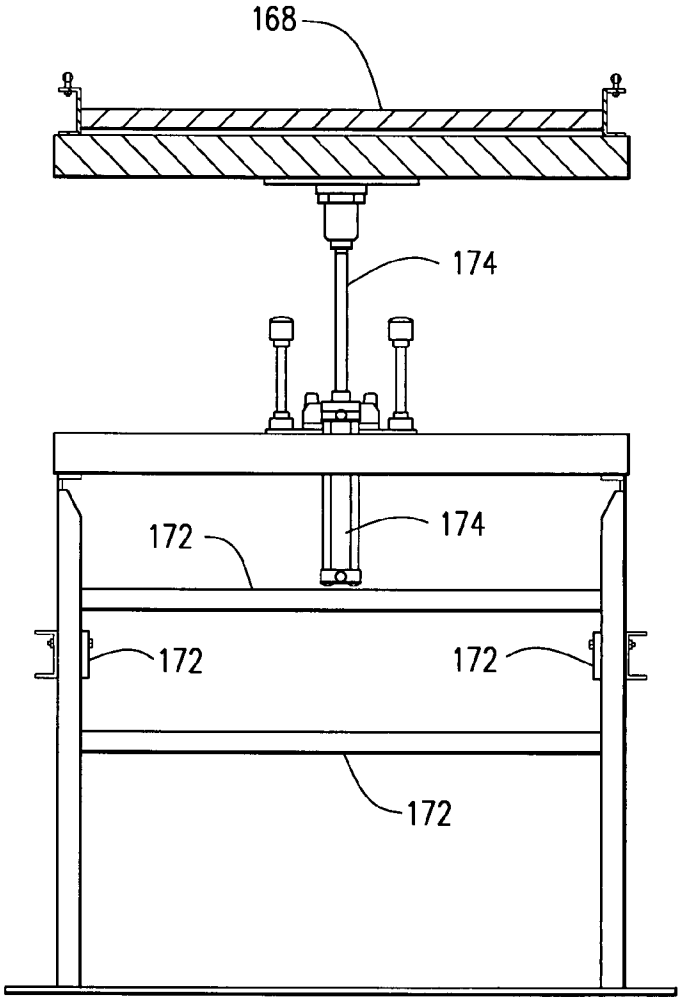
FIG. 21 is a cross-sectional view of the unloading ramp system shown while in the raised position shown in FIG. 20, taken from the same perspective as FIG. 19.
Figure 19:
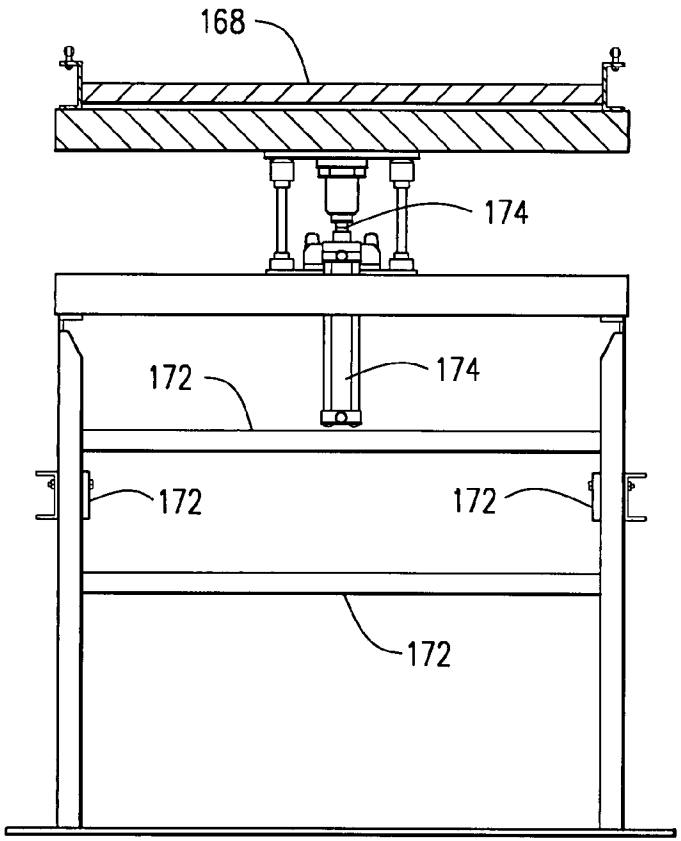
FIG. 19 is a cross-sectional view of the unloading ramp system while in the raised position shown in FIG. 18, taken along line 19-19.

The upper ramp 168 is pivotally mounted at its upper end on a support framework 172. The underside of the upper ramp is engaged by reciprocating cylinder 174, such as an air cylinder, which is installed on the support framework 172. When the cylinder 174 is retracted, the upper ramp 168 assumes a lowered position characterized by a slanted configuration which registers with the lower ramp 170, as shown in FIGS. 18 and 19. When the cylinder 174 is extended, the upper ramp 168 assumes a horizontal raised position which immediately underlies the unloading position of carriage 162, as shown in FIGS. 20 and 21.

FIG. 18 shows the first stage of the operation of the output conveyor system 156 and the downstream lift system 150. A pallet 72, carrying a panel 148, is discharged from welding area 78 and is received on the lift platform 152, which is in its upper position. The carriage 162 is moved longitudinally on the output gantry 160 to its loading position, and the grippers 164 are extended so as to releasably grasp and suspend the panel 148.

FIG. 20 shows the next stage of operation of the output conveyor system 156 and downstream lift system 150. As the downstream lift 150 descends to its lower position, the pallet 72 separates from the panel 148, which remains overhead, held in place by the grippers 164. Once the downstream lift 150 reaches its lower position, the conveyor system 154 is actuated, causing the pallet 72 to move in the upstream direction 70. The pallet 72 discharges onto the upstream conveyor system 68.

As the downstream lift system 150 begins to descend, the carriage 162 moves from its loading position to the unloading position shown in FIG. 20. At approximately the same time, the cylinder 174 is actuated so as to raise the upper ramp 168 to its horizontal raised position underneath the unloading position. The grippers 164 then release the panel 148 from carriage 162, and the panel 148 thereupon drops a short distance onto the horizontal upper ramp 168.

The final stage of the operation of the output conveyor system 156 and downstream lift system 150 is shown in FIG. 22. The cylinder 174 is retracted, thereby rotating the upper ramp 168 from its horizontal raised position to its slanted and lowered position. Under the influence of gravity, the panel 148 slides down the now-slanted upper ramp 168 and onto the registering lower ramp 170. At the base of lower ramp 170, the panel 148 arrives at output point 158, where the panel may be collected for storage or shipment.

After the panel 148 has been released from the carriage 162 at the unloading position, the carriage 162 returns to the loading position, as shown in FIG. 22. Similarly, once the pallet 72 has been discharged from the downstream lift 150 while in its lower position, the downstream lift 150 returns to its upper position. In this configuration, the output conveyor system 156 and downstream lift system 150 are ready to process the next pallet 72 and panel 148 which discharge from the welding area 78.

The apparatus 50 may be provided with a monitoring system (not shown) which determines whether acceptable welds have been formed in a panel prior to its departure from welding area 78. In the event that the monitoring system indicates a failure to form acceptable welds in a particular panel, the output conveyor system 156 is preferably not actuated when that panel arrives at the downstream lift 150. Instead, this panel preferably remains with its associated pallet 72 as the downstream lift 150 lowers. The panel is then recycled by means of the upstream conveyor system 68, and the downstream conveyor system 66. The downstream conveyor system 66 ultimately returns the defectively welded panel to welding area 78 for rewelding.

Changes may be made in the construction, operation and arrangement of the various parts, elements, steps and procedures described herein without departing from the spirit and scope of the invention as defined in the following claims.

The invention claimed is:

1. An apparatus for welding a panel, comprising:

a welding area in which a flat panel framework having opposed first and second sides, each side having plural planar conductive surfaces, is horizontally positionable at a first welding position;

a first welding station situated in a first row within the welding area and positionable in contact with the first side of a panel framework in the first welding position, the first welding station comprising adjacent first and second electrodes of opposed polarity, each electrode having a planar contact surface adapted to contact a planar conductive surface of the first side; and a second welding station situated in a second row within the welding area, longitudinally spaced from the first row, and positionable in contact with the second side of a panel framework in the first welding position, the second welding station comprising adjacent electrodes of opposed polarity.

2. The apparatus of claim 1, further comprising:

a conveyor capable of moving the panel framework horizontally within the welding area from a first welding position to a second welding position.

3. The apparatus of claim 1 in which the welding stations in the first and second rows are capable of welding simultaneously.

4. The apparatus of claim 1, further comprising;

a third welding station situated in a first row within the welding area and positionable adjacent the first side of a panel framework in the first welding position, the third welding station comprising adjacent electrodes of opposed polarity; and a fourth welding station situated in the second row within the welding area, and positionable adjacent the second side of a panel framework in the first welding position, the fourth welding station comprising adjacent electrodes of opposed polarity.

5. The apparatus of claim 1, further comprising:

a panel framework situated within the welding area; in which the panel framework is further characterized as comprising:

at least one channel-shaped first rail having a plurality of longitudinally spaced openings therein; and a plurality of longitudinally spaced upright members, each upright member extending in transverse relationship to the at least one first rail, through the rail channel thereof, and through a corresponding opening therein.

6. The apparatus of claim 5 in which the rail is characterized as having a web with spaced side walls extending therefrom, and in which at least one of the side walls is characterized by a weld-forming region which projects within the rail channel.

7. The apparatus of claim 5 in which the panel framework further comprises:

a second channel-shaped rail, disposed in laterally spaced parallel relationship to the first rail;

in which each upright member extends in transverse relationship to the second rail, and within the rail channel thereof.

8. The apparatus of claim 5 in which the width of the first electrode is least about 75% of the width of the first rail.

9. The apparatus of claim 8 in which the width of the second electrode is at least about 75% of the width of an upright member.

10. The apparatus of claim 5 in which the width of the second electrode is at least about 75% of the width of an upright member.

11. The apparatus of claim 1 in which the first and second electrodes are characterized by a center-to-center separation of between about 2 and about 3 inches.

12. An apparatus for welding a panel, comprising:

a welding area in which a flat panel framework having opposed first and second sides is horizontally positionable at a first welding position;

a panel framework situated within the welding area, the panel framework comprising:

at least one channel-shaped first rail having a plurality of longitudinally spaced openings therein; and a plurality of longitudinally spaced upright members, each upright member extending in transverse relationship to the at least one first rail, through the rail channel thereof, and through a corresponding opening therein; and a first welding station situated in a first row within the welding area and positionable adjacent the first side of a panel framework in the first welding position, the first welding station comprising adjacent first and second electrodes of opposed polarity, the first electrode adapted to contact a first rail and the second electrode adapted to contact one of the upright members.

13. The apparatus of claim 12, further comprising:

a second welding station situated in a second row within the welding area, spaced from the first row, and positionable adjacent the second side of a panel framework in the first welding position, the second welding station comprising adjacent electrodes of opposed polarity.

14. The apparatus of claim 12 in which the rail is characterized as having a web with spaced side walls extending therefrom, and in which at least one of the side walls is characterized by a weld-forming region which projects within the rail channel.

15. The apparatus of claim 12 in which the rail is characterized as having a web with spaced side walls extending therefrom, and in which each side wall is characterized by a weld-forming region which projects within the rail channel.

16. The apparatus of claim 12 in which the panel framework further comprises:

a second channel-shaped rail, disposed in laterally spaced parallel relationship to the first rail;

in which each upright member extends in transverse relationship to the second rail, and within the rail channel thereof, and in which the first welding station further comprises a third electrode adapted to contact the second rail.

17. The apparatus of claim 12 in which the width of the first electrode is least about 75% of the width of the first rail.

18. The apparatus of claim 12 in which the width of the second electrode is at least about 75% of the width of an upright member.

19. The apparatus of claim 12 in which the first and second electrodes are characterized by a center-to-center separation of between about 2 and about 3 inches.

20. The apparatus of claim 12, further comprising:

a conveyor capable of moving the panel framework horizontally within the welding area from a first welding position to a second welding position.

* * * * *